US011933116B2

(12) United States Patent
Zhang et al.

(10) Patent No.: US 11,933,116 B2
(45) Date of Patent: Mar. 19, 2024

(54) ECCENTRIC CENTRALIZER

(71) Applicant: Halliburton Energy Services, Inc., Houston, TX (US)

(72) Inventors: Lizheng Zhang, Houston, TX (US); Wei Zhang, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/815,639

(22) Filed: Jul. 28, 2022

(65) Prior Publication Data

US 2024/0035343 A1 Feb. 1, 2024

Related U.S. Application Data

(60) Provisional application No. 63/365,685, filed on Jun. 1, 2022.

(51) Int. Cl.
*E21B 17/10* (2006.01)

(52) U.S. Cl.
CPC ..... *E21B 17/1078* (2013.01)

(58) Field of Classification Search
CPC ..... E21B 17/1078; E21B 17/1042; E21B 17/105; E21B 17/10; F16F 15/04
See application file for complete search history.

(56) References Cited

U.S. PATENT DOCUMENTS 1,377,325 A * 5/1921 Dunford ..... H02K 5/132 310/87
2,715,552 A * 8/1955 Lane ..... E21B 17/1042 175/325.5
3,125,382 A * 3/1964 Herndon, Jr. et al. ..... E21B 17/105 166/241.7
3,323,327 A 6/1967 Leathers et al.
4,571,215 A 2/1986 Hansen
4,938,299 A 7/1990 Jelsma
5,095,981 A * 3/1992 Mikolajczyk ..... E21B 17/1078 166/241.6
5,247,990 A 9/1993 Sudol et al.
(Continued)

FOREIGN PATENT DOCUMENTS

CA 2890615 A1 5/2014
WO WO 2008/116077 A2 9/2008

*Primary Examiner* — Daniel P Stephenson
(74) *Attorney, Agent, or Firm* — Kilpatrick Townsend & Stockton LLP

(57) ABSTRACT

A centralizer for a downhole probe disposed within an eccentric pipe, the centralizer having an elongated, primary tubular member with three or more elongated centralizer strip assemblies extending along the primary tubular member. Each strip assembly has inner and outer portions opposing one another on the wall of the primary tubular member and spaced apart from one another about the circumference of the wall. The inner portions of the strip assemblies engage the outer diameter of a probe and are all sized and shaped to have the same inner radial length. The outer portions of the strip assemblies have at least two different outer radial lengths, where one of the outer portions has an outer radial length longer than any other outer radial portions. The outer radial lengths are selected so that the sonde can be coaxially positioned within the eccentric pipe relative to the outer diameter of eccentric pipe.

20 Claims, 20 Drawing Sheets

(56) References Cited

U.S. PATENT DOCUMENTS

| | | | | |
|---|---|---|---|---|
| 5,419,395 | A * | 5/1995 | Harvey | E21B 17/10 175/325.1 |
| 5,474,132 | A | 12/1995 | Gallagher | |
| 5,520,246 | A | 5/1996 | Van Steenwyk et al. | |
| 6,429,653 | B1 | 8/2002 | Kruspe et al. | |
| 7,604,059 | B2 * | 10/2009 | Thornton | E21B 17/1042 166/278 |
| 8,511,377 | B2 * | 8/2013 | Casassa | E21B 17/1042 175/57 |
| 9,328,568 | B2 * | 5/2016 | Andrigo | E21B 17/1042 |
| 9,523,246 | B2 * | 12/2016 | Logan | E21B 47/13 |
| 9,850,722 | B2 * | 12/2017 | Logan | E21B 23/01 |
| 10,006,257 | B2 * | 6/2018 | Logan | E21B 7/00 |
| 10,352,111 | B2 * | 7/2019 | Logan | E21B 17/042 |
| 10,358,906 | B2 | 7/2019 | Logan et al. | |
| 10,871,041 | B2 | 12/2020 | Logan et al. | |
| 2004/0200622 | A1 * | 10/2004 | Jennings | E21B 17/1007 166/241.1 |
| 2005/0183864 | A1 * | 8/2005 | Trinder | E21B 17/1078 166/241.1 |
| 2005/0217898 | A1 | 10/2005 | Clark | |
| 2007/0235224 | A1 | 10/2007 | Koger | |
| 2009/0023502 | A1 | 1/2009 | Koger | |
| 2015/0041117 | A1 * | 2/2015 | Schlembach | E21B 17/206 166/113 |
| 2016/0251898 | A1 * | 9/2016 | Angman | E21B 17/1078 175/57 |
| 2017/0204685 | A1 * | 7/2017 | Gao | E21B 17/1028 |
| 2019/0353027 | A1 * | 11/2019 | Stack | E21B 17/1042 |
| 2020/0208474 | A1 * | 7/2020 | Al-Qasim | E21B 17/10 |
| 2021/0025245 | A1 * | 1/2021 | Mackay | E21B 17/1028 |
| 2023/0127866 | A1 * | 4/2023 | Nease | E21B 17/1078 166/241.6 |

* cited by examiner

ECCENTRIC CENTRALIZER

PRIORITY

The present application claims priority to U.S. Provisional Application No. 63/365,685, filed Jun. 1, 2022, the benefit of which is claimed and the disclosure of which is incorporated herein by reference in its entirety.

TECHNICAL FIELD

This invention relates to hydrocarbon drilling and production, and more specifically to systems for supporting downhole probes in wellbores.

BACKGROUND

Hydrocarbons, such as oil and gas, are commonly obtained from wellbores drilled into subterranean formations. In drilling wellbores into hydrocarbon-producing subterranean formations, it has become commonplace to include in a drill string one or more logging tools. There may be a vast array of combinations of logging-while-drilling (LWD) and measuring-while-drilling (MWD) tools that may be placed within a drill string, but these tools generally include electronic systems such as electrical circuits and sensors to perform specific tasks. Such electronic systems may likewise be deployed down hole during production from a wellbore.

Whether in drilling or production, the operating environment experienced by downhole devices is very harsh. By virtue of the devices being part of the drill string, the devices experience relatively high accelerating forces, which may be caused by vibration of the drill bit cutting through the downhole formations. The devices may also experience temperatures far in excess of normal surface conditions. The temperature and vibration experienced may exceed the specified ranges for some of the components that make up the downhole devices, such as electrical components.

In most downhole applications, simply attaching the sensors to the downhole piping or tubing, whether a drill string or production tools, is not an acceptable means of delivering the electronic systems downhole because of the harsh downhole environment. Therefore, it often becomes necessary to package the electronic systems as a sonde in a protective housing to ensure safe delivery of the electronic systems. Where the sonde is deployed as part of a drill string, the sonde may be positioned within a drill string tubular or collar.

Moreover, once deployed, to ensure proper functioning, it may be necessary to support the sonde in a specific location or orientation within the wellbore. Most often, this location and orientation may be along the central axis of a tubular or the wellbore in which the sonde is deployed, but at other times, this location may be offset from the central axis of the tubular or wellbore. Support of the sonde may also reduce sonde vibration and minimizes interference of the sonde with fluid flow around the sonde (such as drilling mud when deployed in a drill string collar), thereby reducing possible erosion of the sonde or the tubular in which the sonde is deployed.

BRIEF DESCRIPTION OF THE DRAWINGS

For a more complete understanding of the present disclosure and its features and advantages, reference is now made to the following description, taken in conjunction with the accompanying drawings, in which.

DESCRIPTION OF ILLUSTRATIVE EMBODIMENTS

Figure 1:
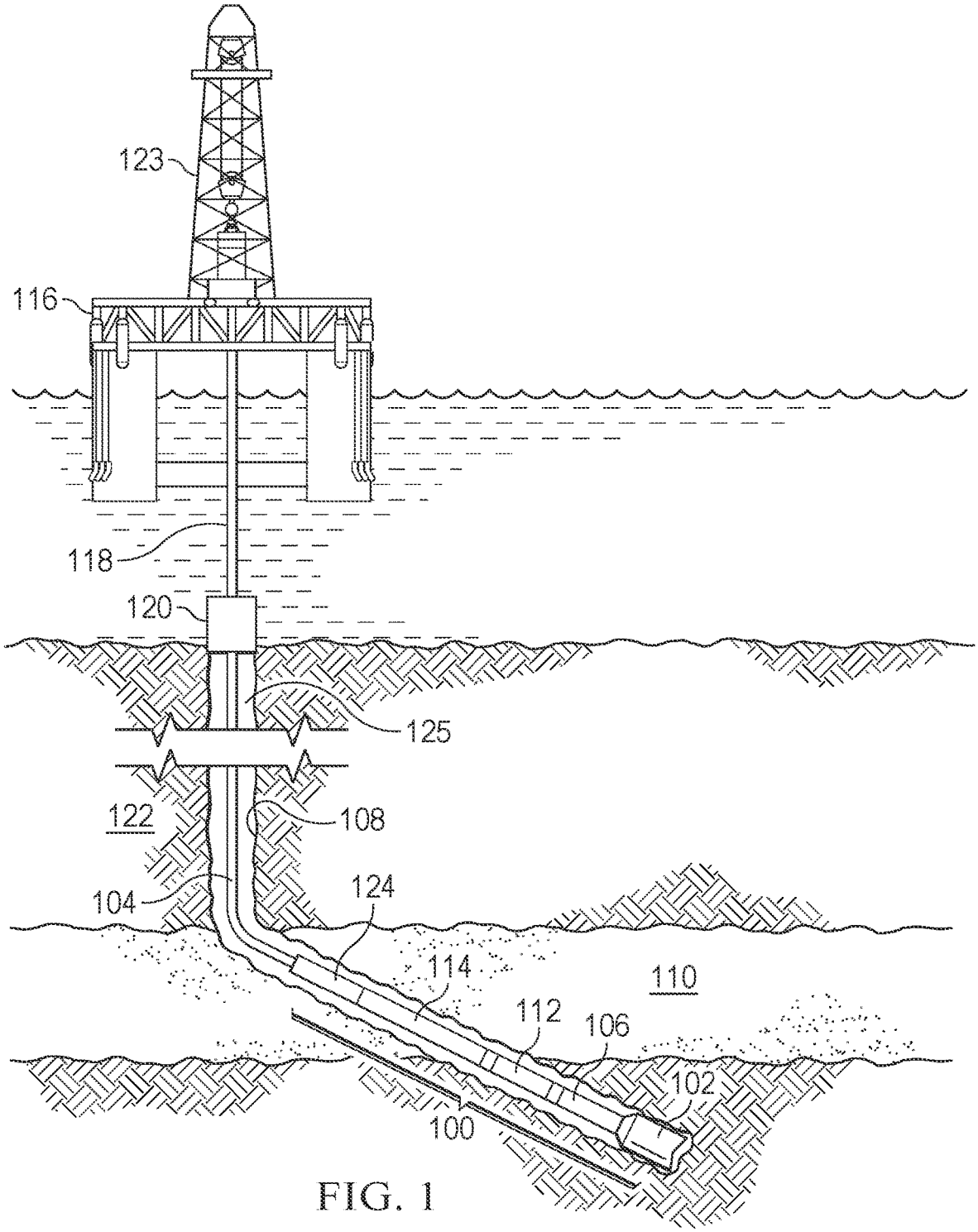
FIG. 1 is a diagram of an offshore drilling system in accordance with one or more embodiments of the present disclosure.

Turning to FIG. 1, a drilling system for a drilling operation is illustrated. In particular, FIG. 1 shows a bottomhole assembly 100 for a wellbore 446 108 in formation 110, where the bottomhole assembly 100 illustratively comprises a drill bit 102 on the distal end of the drill string 104.

Various logging-while-drilling (LWD) and measuring-while-drilling (MWD) tools may also be coupled within the bottomhole assembly 100. In the example system, a logging tool 106 may be coupled just above the drill bit 102, where the logging tool may read data associated with the wellbore 446 108 (e.g., MWD tool), or the logging tool 106 may read data associated with the surrounding formation (e.g., a LWD tool). In some cases, the bottomhole assembly 100 may comprise a mud motor 112. The mud motor 112 may derive energy from drilling fluid flowing within the drill string 104 and, from the energy extracted, the mud motor 112 may rotate the drill bit 102 (and if present the logging tool 106) separate and apart from rotation imparted to the drill string by surface equipment. Additional logging tools may reside above the mud motor 112 in the drill string, such as illustrative logging tool 114. Regardless of where it is located in the bottomhole assembly 100, each logging tool 106, 114 typically consists of an electronics system packaged within a sonde and positioned within a drill collar that forms the outer housing of the logging tool 106, 114.

The bottomhole assembly 100 is lowered from a drilling platform 116 by way of the drill string 104. In marine operations, the drill string 104 extends through a riser 118 and a well head 120.

Drilling equipment supported within and around derrick 123 may rotate the drill string 104, and the rotational motion of the drill string 104 and/or the rotational motion created by the mud motor 112 causes the bit 102 to form the wellbore 446 108 through the formation material 122. The volume defined between the drill string 104 and the wellbore 446 108 is referred to as the annulus 125. The wellbore 446 108 penetrates subterranean zones or reservoirs in formation 110 believed to contain hydrocarbons in a commercially viable quantity.

The bottomhole assembly 100 may further comprise a communication subsystem including, for example, a telemetry module 124. As with logging tools 106, 114 described above, telemetry module 124 likewise may consist of an electronics system packaged within a sonde and positioned within a drill collar that forms the outer housing of the telemetry module 124.

Regardless of where an electronics sonde is positioned within a bottom hole assembly 100, or for that matter, in any tubular within a wellbore 108, whether the tubular is utilized in a drilling system such as bottom hole assembly 100, or a production system, it is generally desirable to ensure that the sonde is positioned so as to be coaxial with the wellbore 108.

Figure 2:
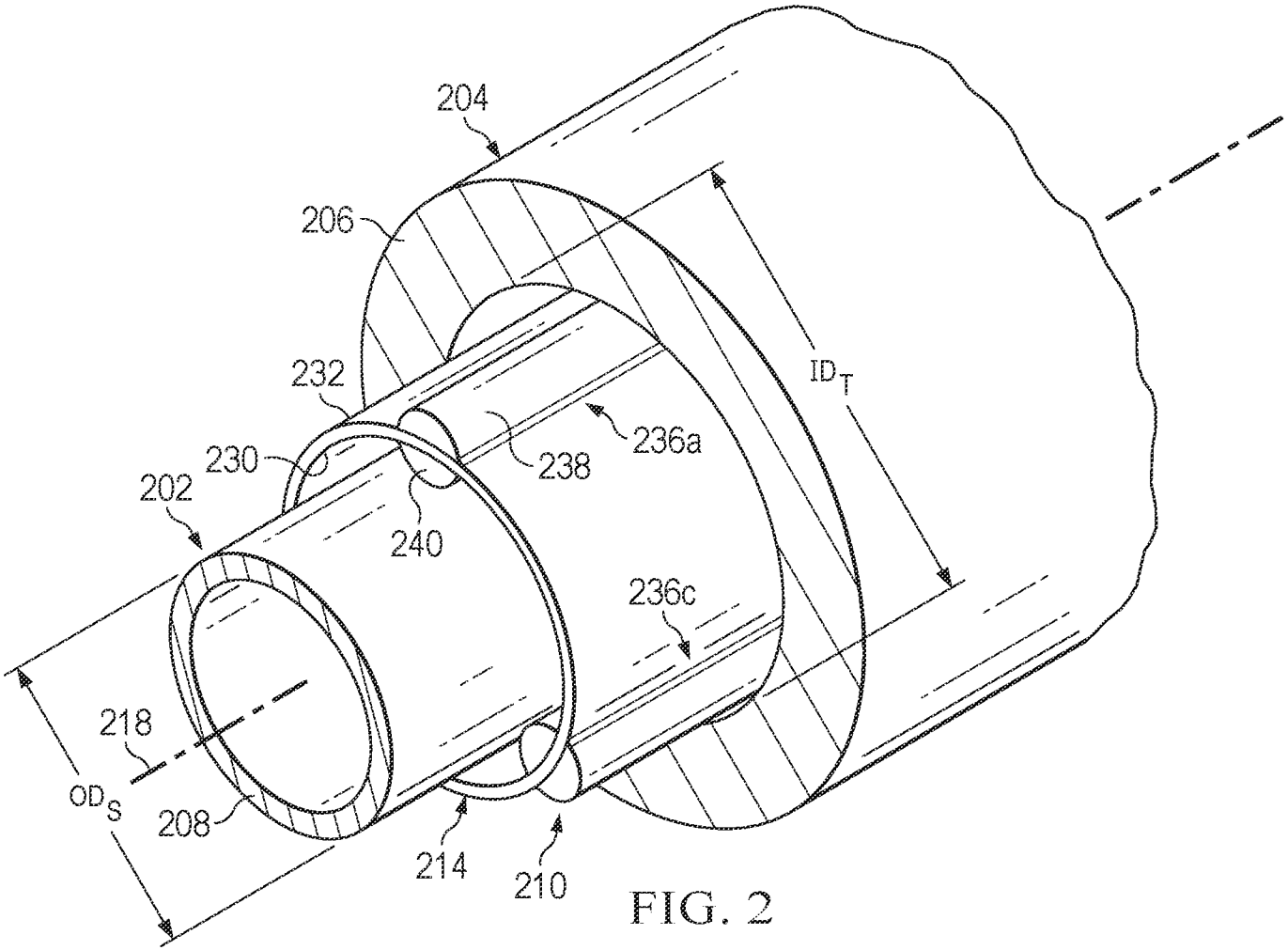
FIG. 2 is a cut-away elevational view of first embodiment of a centralizer securing a sonde within a drill collar.
Figure 3:
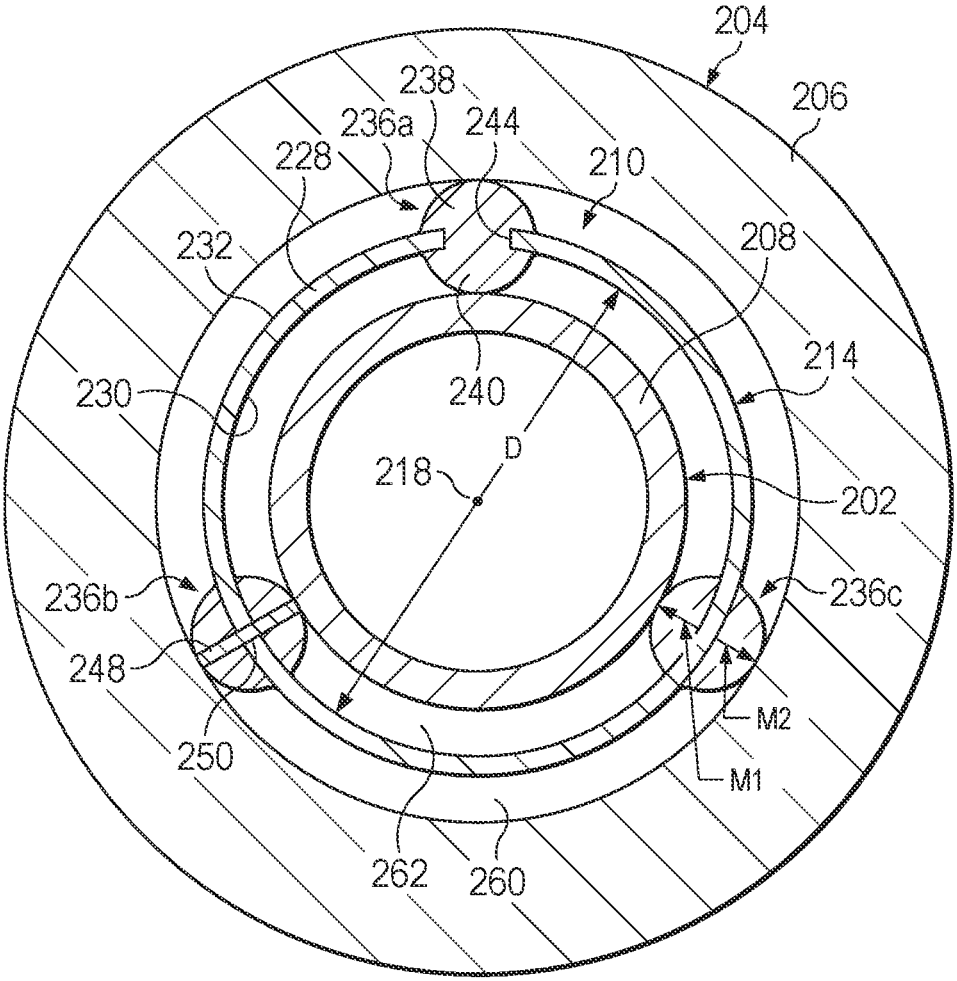
FIG. 3 is a planar, cross-sectional view of the centralizer, sonde and drill collar shown in FIG. 2.
Figure 4:
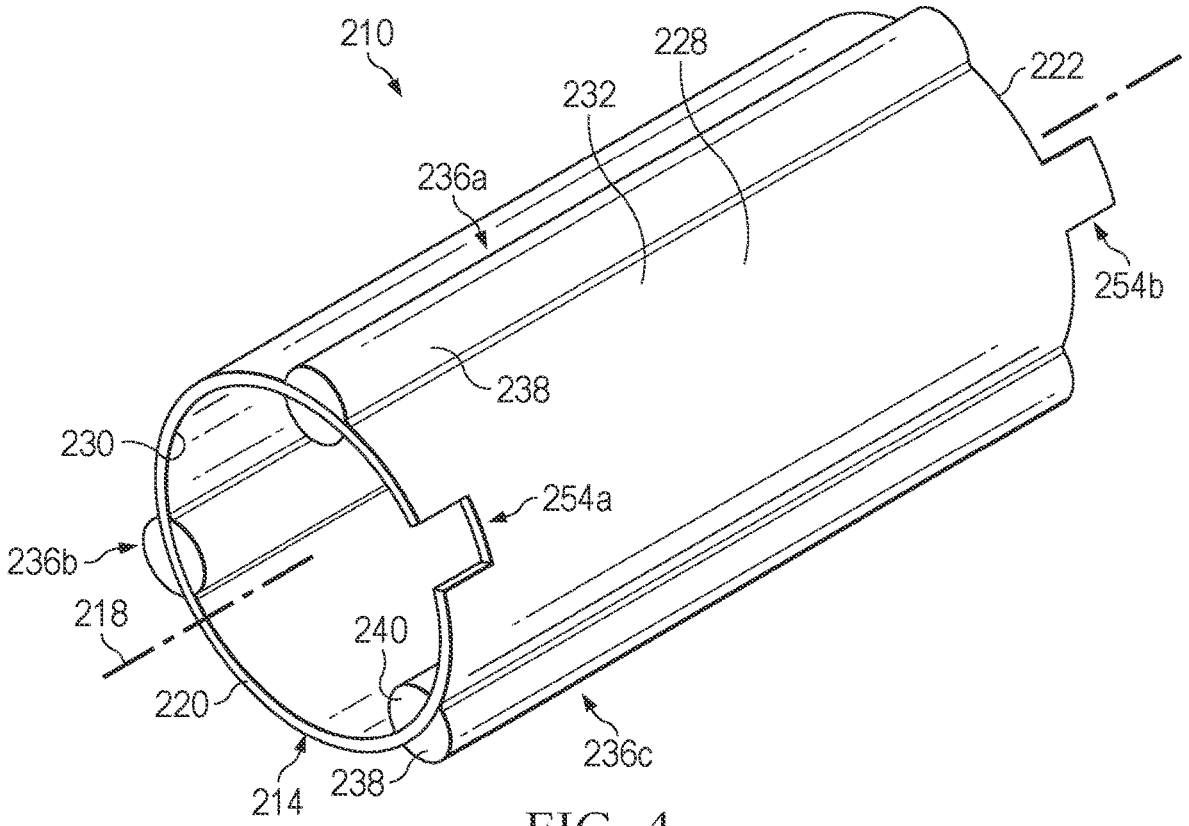
FIG. 4 is an elevational view of the centralizer shown in FIGS. 2 and 3.

Turning to FIGS. 2-4, a sonde 202 is shown supported within a tubular 204. Although tubular 204 is illustrated as a drill collar and may be referred to as a drill collar herein for illustrative purposes, tubular 204 may be any type of pipe or tubing in which sonde 202 is deployed. Tubular 204 may generally include a tubular wall 206 having a tubular inner diameter $ID_T$. Likewise, sonde 202 as described herein is not limited to any particular type of sonde, but is likewise provided for illustrative purposes only. Sonde 202 may generally include a sonde tubular wall 208 having a sonde outer diameter $OD_S$.

A centralizer 210 is shown supporting sonde 202 within tubular 204. Centralizer 210 is formed of an elongated, primary tubular member 214 extending along a centralizer axis 218. Primary tubular member 214 has a first end 220 and a second end 222 (see FIG. 4). A tubular wall 228 extends between the first end 220 and second end 220. Tubular wall 228 has an inner surface 230 and an outer surface 232. Two or more elongated centralizer strip assemblies 236 extend along at least a portion of the primary tubular member 214. In the illustrated embodiment, thee elongated centralizer strip assemblies 236*a*, 236*b*, 236*c* are shown.

Each elongated centralizer strip assembly 236 has an outer portion 238 and an inner portion 240.

Elongated centralizer strip assembly 236 is mounted or secured on tubular wall 228 so that the outer portion 238 of each centralizer strip assembly 236 is adjacent the outer surface 232 of the tubular wall 228 and the inner portion 240 of each centralizer strip assembly 236 is adjacent the inner surface 230 of the tubular wall 228 and the elongated centralizer strip assembly 236 extends generally parallel to centralizer axis 218 for at least a portion of the length of tubular wall 228 between the first and second ends 220, 222 of tubular member 214. In one or more embodiments, the inner portion 240 and outer portion 238 of each centralizer strip assembly 236 oppose one another on opposite sides of the tubular wall 228. Fixation of outer portion 238 and an inner portion 240 to tubular wall 228 is not limited to a particular configuration. In the illustrated embodiment, centralizer strip assembly 236*a* is shown extending through a perforation, slot or aperture 244 formed in wall 228 so that outer portion 238 and an inner portion 240 can be glued, bonded or melted together or otherwise molded as a single integrally formed piece along wall 228. In such embodiments, the inner portion 240 and outer portion 238 may be of a single, solid cross-section. Alternatively, with regard to centralizer strip assembly 236*b*, outer portion 238 and inner portion 240 are joined together by a fastener 248 extending through an aperture 250 formed in tubular wall 228. Alternatively, with regard to centralizer strip assembly 236*c*, outer portion 238 and inner portion 240 may be separately attached to tubular wall 228, where outer portion 238 is mounted to outer surface 232 of the tubular wall 228 and inner portion 240 is mounted to inner surface 230 of tubular wall 228, such as by bonding, gluing, melting or the like or with fasteners.

In one or more embodiments, each elongated centralizer strip assembly 236 is substantially linear and parallel to centralizer axis 218.

Although not limited to a particular shape, in one or more embodiments, primary tubular member 214 is circular in cross section. It will be appreciated that in other embodiments, primary tubular member 214 may have other shapes, such as polygonal in cross section, with at least three sides.

In one or more embodiments, elongated centralizer strip assembly 236 may be formed of a polymer, such as an elastomer or plastic. In one or more embodiments, primary tubular member 214 is formed of metal.

In one or more embodiments, the elongated centralizer strip assemblies 236 are symmetrically spaced apart from one another on tubular wall 228 about centralizer axis 218.

In one or more embodiments, an outer flow passage 260 is defined between the outer portion 238 of two elongated centralizer strip assemblies 236 and an inner flow passage 262 is defined between the inner portion 240 of two elongated centralizer strip assemblies 236.

In one or more embodiments, outer portion 238 and an inner portion 240 are of the same shape and size. While elongated centralizer strip assembly 236 is shown as generally being symmetrical, where outer portion 238 and inner portion 240 are of the same shape and dimension, it will be appreciated in other embodiments that outer portion 238 and inner portion 240 need not be of the same shape or dimension. In one or more embodiments, regardless of the particular shape of any given outer portion 238 or inner portion 240, the inner portion 240 of each elongated strip assembly 236 has an inner radial length M1 and the outer portion 238 of each elongated strip assembly 236 has an outer radial length M2. In one or more embodiments, the outer radial length M2 of each elongated centralizer strip assembly 236 is the same. Likewise, in one or more embodiments, the inner radial length M1 of each elongated centralizer strip assembly 236 is the same. The relative cross section flow areas of flow passages 260 and 262 can be adjusted in this regard by adjusting the size and shape of outer portion 238 and inner portion 240. For example, as illustrated in FIG. 3, the inner radial length M1 can be smaller than the outer radial length M2 to increase the cross-sectional area of the flow passage 260 and decrease the cross-sectional areal of flow passage 262. In other embodiments, inner and outer radial lengths M1 and M2 can be the same and outer portion 238 and inner portion 240 may be symmetrical. In this regard, outer portion 238 and inner portion 240 may be arcuate in cross-sectional shape so that together each centralizer strip assembly 236 forms a secondary elongated tubular. Although outer portion 238 and inner portion 240 are shown as being generally arcuate or semi-circular (such that elongated centralizer strip assembly 236 is generally circular) in shape, outer portion 238 and inner portion 240 may have other shapes, including but not limited triangular or rectangular or blade shaped, and outer portion 238 and inner portion 240 may have the same shape or different shapes as desired to achieve desired sonde 202 support and flow along flow passages 260 and 262.

As best seen in FIG. 4, in one or more embodiments, primary tubular member 214 may include an alignment feature 254 at one or both of the first end 220 and second end 222. In the illustrated embodiment, an alignment feature 254*a* is formed at the first end 220 and an alignment feature 254*b* is formed at the second end 222, where successive features 254 on successively aligned centralizers 210 may be disposed to cooperate with one another. Thus, in FIG. 4, alignment feature 254*a* is shown as a notch and alignment feature 254*b* is shown as a finger, so that the finger 254*b* of one centralizer 210 seats in the notch 254*a* of an adjacent centralizer 210, thereby preventing relative movement between adjacent centralizers 210 which could otherwise occur from the fluid flow between the sonde 202 and the centralizer 210 or fluid flow between the centralizer 210 and tubular 204.

Figure 5:
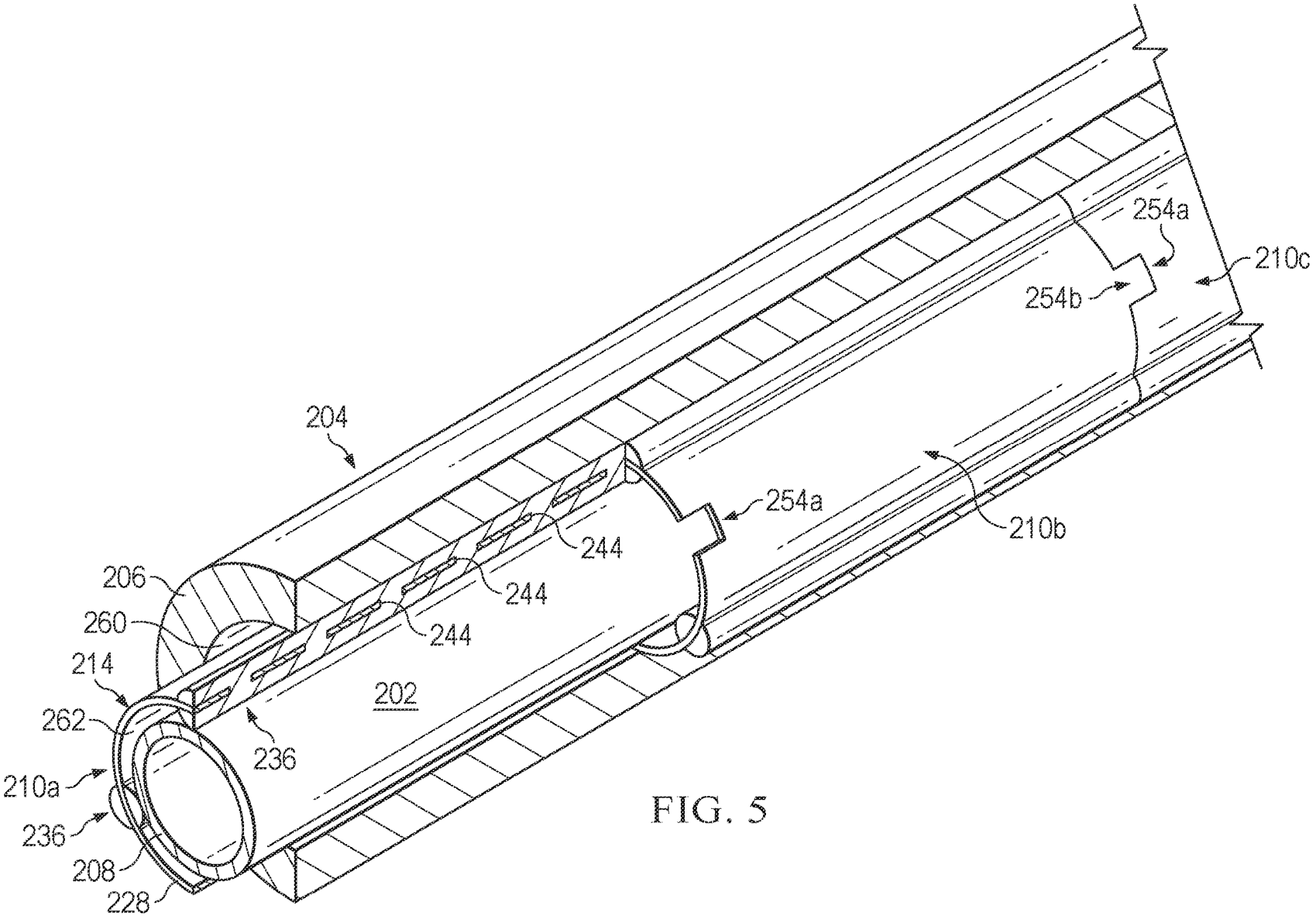
FIG. 5 is a cut-away elevational view of a plurality of the centralizers shown in FIGS. 2 and 3 coupled together within a drill collar.

FIG. 5 illustrates a plurality of centralizers 210*a*, 210*b* and 210*c* aligned within a tubular 204 and supporting sonde 202. In the embodiment shown in FIG. 5, it can be seen that on centralizer 210*a*, elongated centralizer strip assembly 236 is a single, integrally formed body molded onto primary tubular member 214. In this regard, for each elongated centralizer strip assembly 236, primary tubular member 214 may include a plurality of aligned, spaced apart apertures or slots 244 extending generally parallel with centralizer axis 218 between the first end 220 and second end 222. Elongated centralizer strip assembly 236 supports primary tubular member 214 so that tubular wall 228 of centralizer 210 is spaced apart from tubular wall 206 of tubular 204, thus permitting a flow passage 260 therebetween. Likewise, elongated centralizer strip assembly 236 supports sonde 202 so that tubular wall 228 of centralizer 210 is spaced apart from sonde tubular wall 208 of sonde 202, thus permitting a flow passage 262 therebetween. Thus, the diameter D of primary tubular member 214 is selected to be larger than the sonde outer diameter $OD_S$ of sonde 202 and the tubular inner diameter $ID_T$ of tubular 204.

With continuing reference to FIG. 5, it can be seen that the plurality of centralizers 210*a*, 210*b* and 210*c* are engaged with one another utilizing alignment feature 254. In particular, the centralizer 210*b* includes a notch 254*a* disposed to engage a finger 254*b* (not shown) of centralizer 210*a*, and centralizer 210*b* includes a finger 254*b* disposed to engage a notch 454*a* of centralizer 210*c*. Thus, as fluid flows through flow passages 260 and 262, centralizers 210*a*, 210*b* and 210*c* will be inhibited from movement relative to one another.

Figure 6:
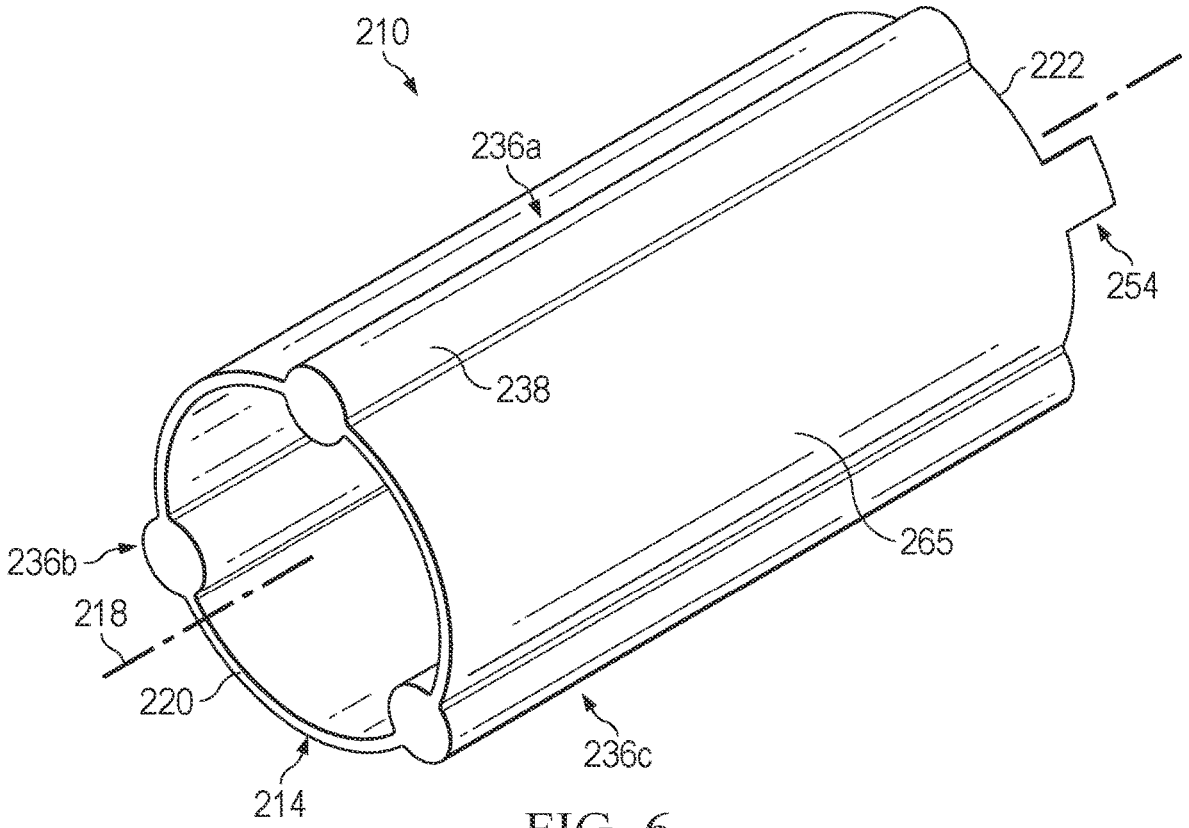
FIG. 6 is an elevational view of the centralizer shown in FIGS. 2 and 3 but with an overmolding.

FIG. 6 illustrates the centralizer 210 of FIG. 4, but with an overmolding 265 applied to centralizer 210. In one or more embodiments, the overmolding may be rubber. In any event, in FIG. 6, centralizer 210 is shown having an elongated, primary tubular member 214 extending along a centralizer axis 218. Primary tubular member 214 has a first end 220 and a second end 222 with a tubular wall 228 extending between the first end 220 and second end 222. Centralizer 210 of FIG. 6 also includes three elongated centralizer strip assembly 236*a*, 236*b*, 236*c* symmetrically spaced apart from one another about centralizer axis 218 and extending parallel to centralizer axis 210 along the full length of primary tubular member 214. In this overmolded embodiment, tubular member 214 also is shown having include an alignment feature 254 at second end 222. In some embodiments, the overmolding 265 may be applied to both the primary tubular member 214 and the elongated centralizer strip assemblies 236*a*, 236*b*, 236*c*, while in other embodiments, the overmolding may be applied to only the primary tubular member 214. It will be appreciated that the overmolding is provided to allow the centralizer to be installed over the sonde and into the tubular (collar) easily while providing support. The overmolding also protects the metallic parts from erosion and corrosion, and permits less expensive materials to be utilized in manufacturing of the centralizer. For example, the tubular 214 thus can be constructed of low-cost material, such as aluminum alloys, that would normally corrode in downhole conditions.

Figure 7:
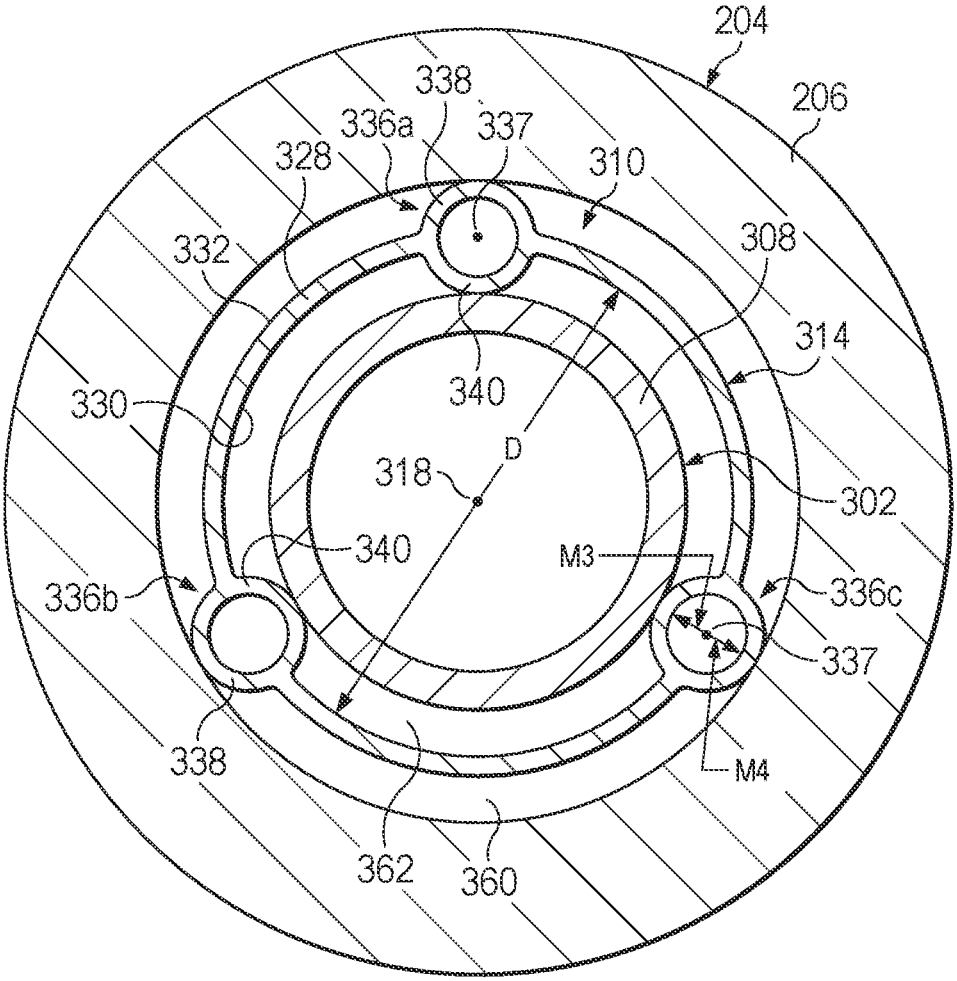
FIG. 7 is a planar, cross-sectional view of a second embodiment of a centralizer securing a sonde within a drill collar.
Figure 8:
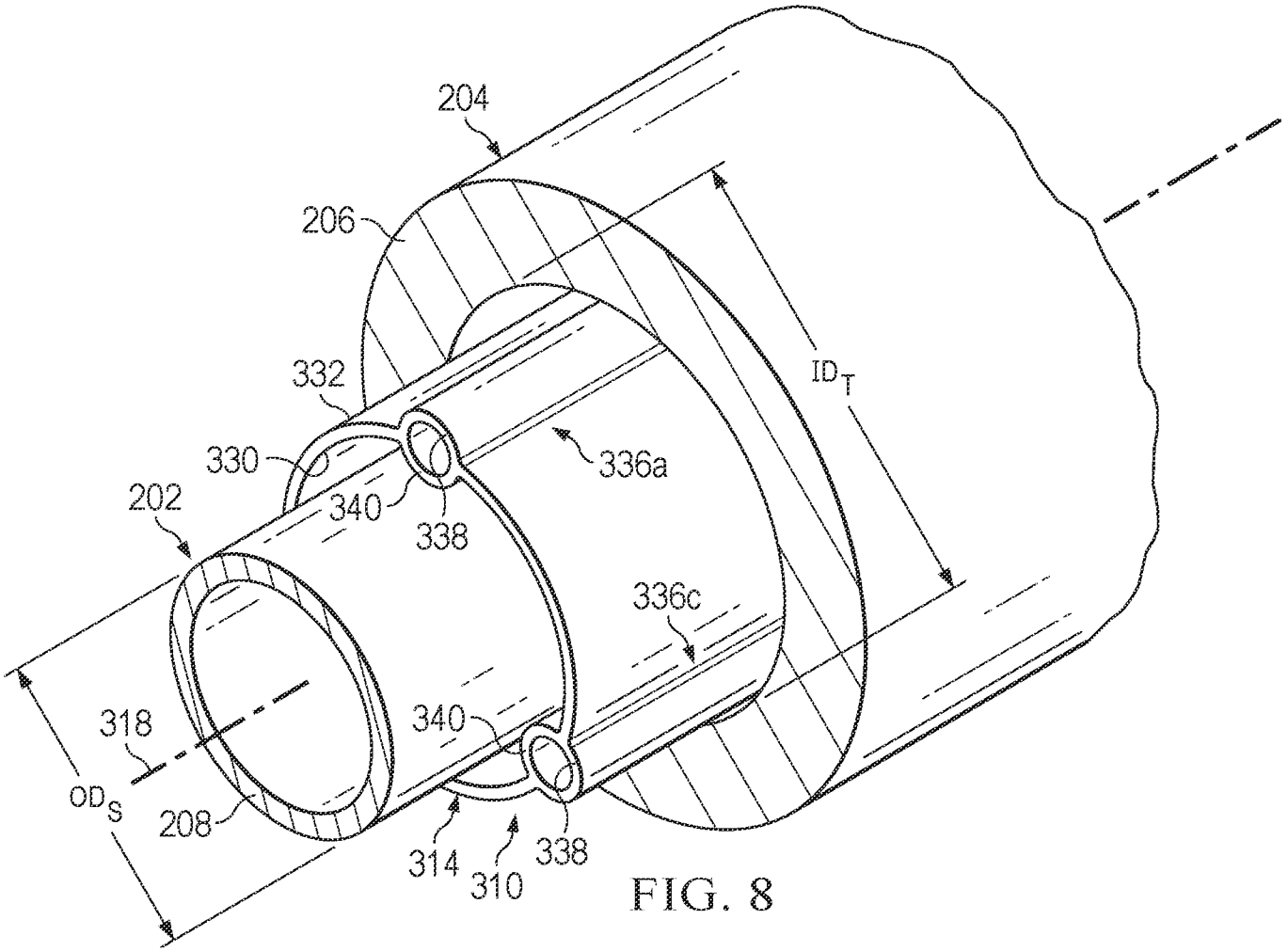
FIG. 8 is a cut-away elevational view of the centralizer of FIG. 7 securing a sonde within a drill collar.

Turning to FIGS. 7 and 8, another embodiment of a centralizer 310 is illustrated supporting a sonde 202 within a tubular 204. Centralizer 310 is formed of an elongated, primary tubular member 314 extending along a centralizer axis 318. Primary tubular member 314 has a first end 320 and a second end 322 (see FIG. 9). A tubular wall 328 extends between the first end 320 and second end 320. Tubular wall 328 has an inner surface 330 and an outer surface 332. Two or more elongated centralizer strip assemblies 336 extend along at least a portion of the primary tubular member 314. In the illustrated embodiment, thee elongated centralizer strip assemblies 336*a*, 336*b*, 336*c* are shown. In one or more embodiments, each elongated centralizer strip assembly 336 is substantially linear and parallel to centralizer axis 318.

Each elongated centralizer strip assembly 336 has an outer portion 338 and an inner portion 340.

Each of the outer portion 338 and an inner portion 340 of elongated centralizer strip assembly 336 may be integrally formed with tubular wall 328. In one or more embodiments, the inner portion 340 and outer portion 338 are formed on opposite sides of wall 328, with inner portion 340 formed along the inner surface 330 of wall 328 and outer portion 338 formed along the outer surface 332 of wall 328 so that elongated centralizer strip assembly 336 extends along a strip assembly axis 337 that is generally parallel to centralizer axis 318 for at least a portion of the length of tubular wall 328 between the first and second ends 320, 322 of tubular member 314.

Although not limited to a particular shape, in one or more embodiments, primary tubular member 314 is circular in cross section. It will be appreciated that in other embodiments, primary tubular member 314 may have other shapes, such as polygonal in cross section, with at least three sides.

While elongated centralizer strip assembly 336 is shown as generally being symmetrical, where outer portion 338 and inner portion 340 are of the same shape and dimension, it will be appreciated in other embodiments that outer portion 338 and inner portion 340 need not be of the same shape or dimension. In one or more embodiments, an outer flow passage 360 is defined between the outer portion 338 of two elongated centralizer strip assemblies 336 and an inner flow passage 362 id defined between the inner portion 340 of two elongated centralizer strip assemblies 336. The relative cross-sectional areas of flow passages 360 and 362 can be adjusted in this regard by adjusting the size and shape of outer portion 338 and inner portion 340. For example, as illustrated in FIG. 7, the measurement M3 can be smaller than the measurement M4 to increase the cross-sectional area of the flow passage 360 and decrease the cross-sectional areal of flow passage 362. In other embodiments, measurements M3 and M4 can be the same and outer portion 338 and inner portion 340 may be symmetrical. In this regard, outer portion 338 and inner portion 340 may be arcuate in cross-sectional shape so that together each centralizer strip assembly 336 is a hollow, secondary elongated tubular. Although outer portion 338 and inner portion 340 are shown as being generally arcuate or semi-circular (such that elongated centralizer strip assembly 336 is generally a hollow circular in cross-section) in shape, outer portion 338 and inner portion 340 may have other shapes, including but not limited triangular or rectangular or blade shaped, and outer portion 338 and inner portion 340 may have the same shape or different shapes as desired to achieve desired sonde 202 support and flow through flow passages 360 and 362.

In one or more embodiments, elongated centralizer strip assembly 336 may be formed of the same material as primary tubular member 314. In one or more embodiments, elongated centralizer strip assembly 336 and primary tubular member 314 may be formed of a polymer, while in other embodiments, elongated centralizer strip assembly 336 and primary tubular member 314 may be formed of a metal. As shown, in one or more embodiments, elongated centralizer strip assembly 336 and primary tubular member 314 are integrally formed.

In one or more embodiments, the elongated centralizer strip assemblies 336 are symmetrically spaced apart from one another on tubular wall 328 about centralizer axis 318.

Figure 9:
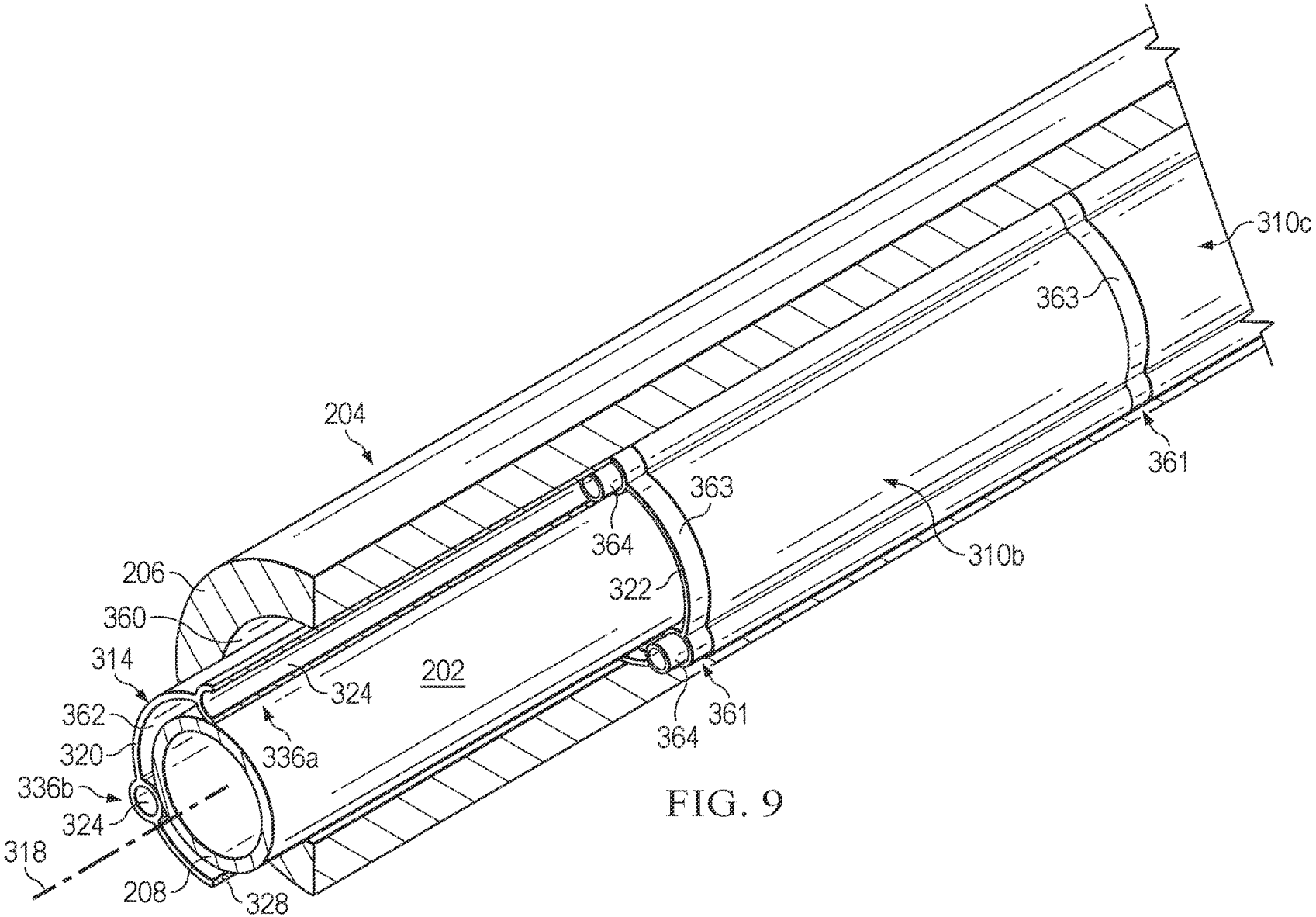
FIG. 9 is a cut-away elevational view of a plurality of the centralizers shown in FIGS. 7 and 8 coupled together within a drill collar and supporting a sonde.

FIG. 9 illustrates a plurality of centralizers 310*a*, 310*b* and 310*c* aligned within a tubular 204 and supporting sonde 202. In the embodiment shown in FIG. 9, it can be seen that each elongated centralizer strip assembly 336 is integrally formed with tubular member 314 as described above. In this regard, each elongated centralizer strip assembly 336, regardless of the shape, may be hollow or open in some embodiments as shown at 324, at least adjacent one or both of the first end 320 and second end 322 of primary tubular member 314. The hollow ends 324 form an alignment feature disposed to receive an adaptor assembly 361 to secure adjacent centralizers 310 to one another such as is shown in FIG. 9. Each adaptor assembly 361 may include a support ring 363 on which is mounted a connector 364 disposed to seat in a hollow end 324. Although not limited to a particular shape or configuration, in one or more embodiments, connector 364 is shaped to correspond to the shape of hollow end 324 of elongated centralizer strip assembly 336. Thus, where elongated centralizer strip assembly 336 is circular in cross-section such as shown, connector 364 may be a tubular pin that seats in the hollow centralizer strip assembly 336. In other embodiments, connector 364 may be triangular, or rectangular or otherwise shaped to correspond to the cross-sectional shape of centralizer strip assembly 336. In one or more embodiments, support ring 363 is shaped to correspond with the cross section of primary tubular member 314.

Figure 10:
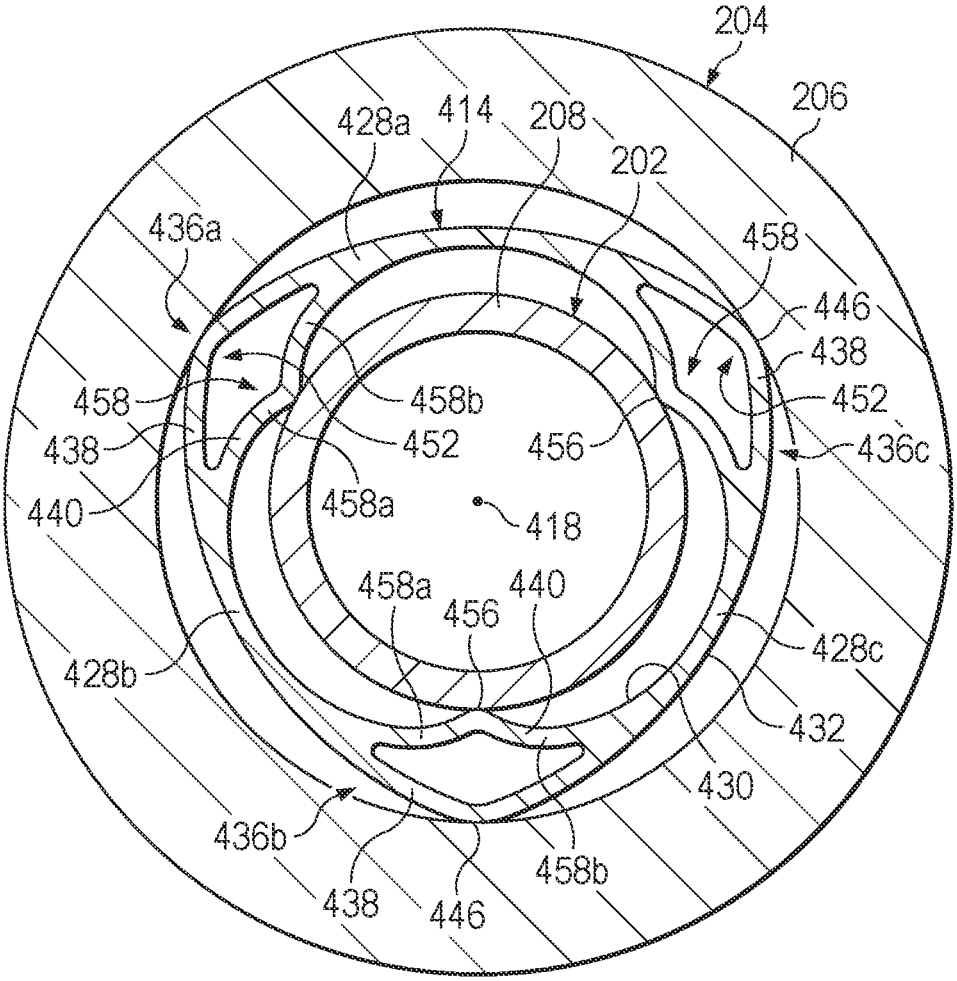
FIG. 10 is a planar, cross-sectional view of another configuration of the centralizer of FIG. 7.

FIG. 10 illustrates a centralizer 410 that is similar to the centralizer 310 of FIGS. 7-9, but where primary tubular member 414 is polygonal in cross section, with at least three walls 428 and elongated centralizer strip assembly 436 is hollow. As shown, centralizer 410 is illustrated supporting a sonde 202 within a tubular 204. Centralizer 410 is formed of an elongated, primary tubular member 414 extending along a centralizer axis 418 and having a tubular wall 428. Tubular wall 428 has an inner surface 430 and an outer surface 432. In the illustrated embodiment, primary tubular member 414 has three walls 428, where adjacent walls 428 join together at and intersection 446 with an elongated centralizer strip assemblies 436 formed at each intersection 446, thereby forming three elongated centralizer strip assemblies 436*a*, 436*b*, 436*c*, each of which extends along at least a portion of the primary tubular member 414 in a manner as described above with respect to centralizers 310 and 210. In one or more embodiments, each elongated centralizer strip assembly 436 is substantially linear and parallel to centralizer axis 418.

Each elongated centralizer strip assembly 436 has an outer portion 438 and an inner portion 440. Each of the outer portion 438 and an inner portion 440 of elongated centralizer strip assembly 436 may be integrally formed with tubular wall 428 so that outer portion 438 is coextensive with the outer surface 432 of two adjoining walls 428, such as 428*a* and 428*b*, and inner portion 440 is coextensive with the inner surface 430 of the two adjoining walls 428. In this regard, the inner portion 440 and out portion 438 of each centralizer strip assembly 436 may be integrally formed with two adjoining tubular walls 428.

In one or more embodiment, each wall 428 is arcuate in shape around centralizer axis 418 so that the outer portion 438 centralizer strip assembly 436 may flex inward at the intersection 446 of two adjoining walls 428, thus forming a flexible outer spring 452 and allowing centralizer 410 to yield at each intersection 446 in order to engage tubular wall 206 of tubular 204 at its tubular inner diameter $ID_T$. In other words, the outwardly bowed, arcuate shape of walls 428 allow deflection at each intersection 446 so that centralizer 410 can engage tubular wall 204 at each intersection 446.

Likewise, the inner portion 440 of each strip assembly 436 comprises an inner spring 458 allowing centralizer 410 to yield at a contact point 456 in order to engage the sonde tubular wall 208 of a sonde 202 at its sonde outer diameter $OD_S$. In one or more embodiments, inner spring 458 may be formed of a first inwardly depending leaf 458*a* and a second inwardly depending leaf 458*b* that join together at contact point 456. In such embodiments, the strip assembly 436 may be triangular in cross section. In other embodiments, inner spring 458 may be convex in shape relative to centralizer axis 418.

As described above, regardless of the cross-sectional shape of the strip assemblies 436, the hollow cross-section formed by spaced apart outer spring 452 and inner spring 458 allows each strip assembly 436 to receive and adaptor assembly 361 (see FIG. 10) so that successive strip assemblies 436 may be longitudinally aligned.

Figure 11:
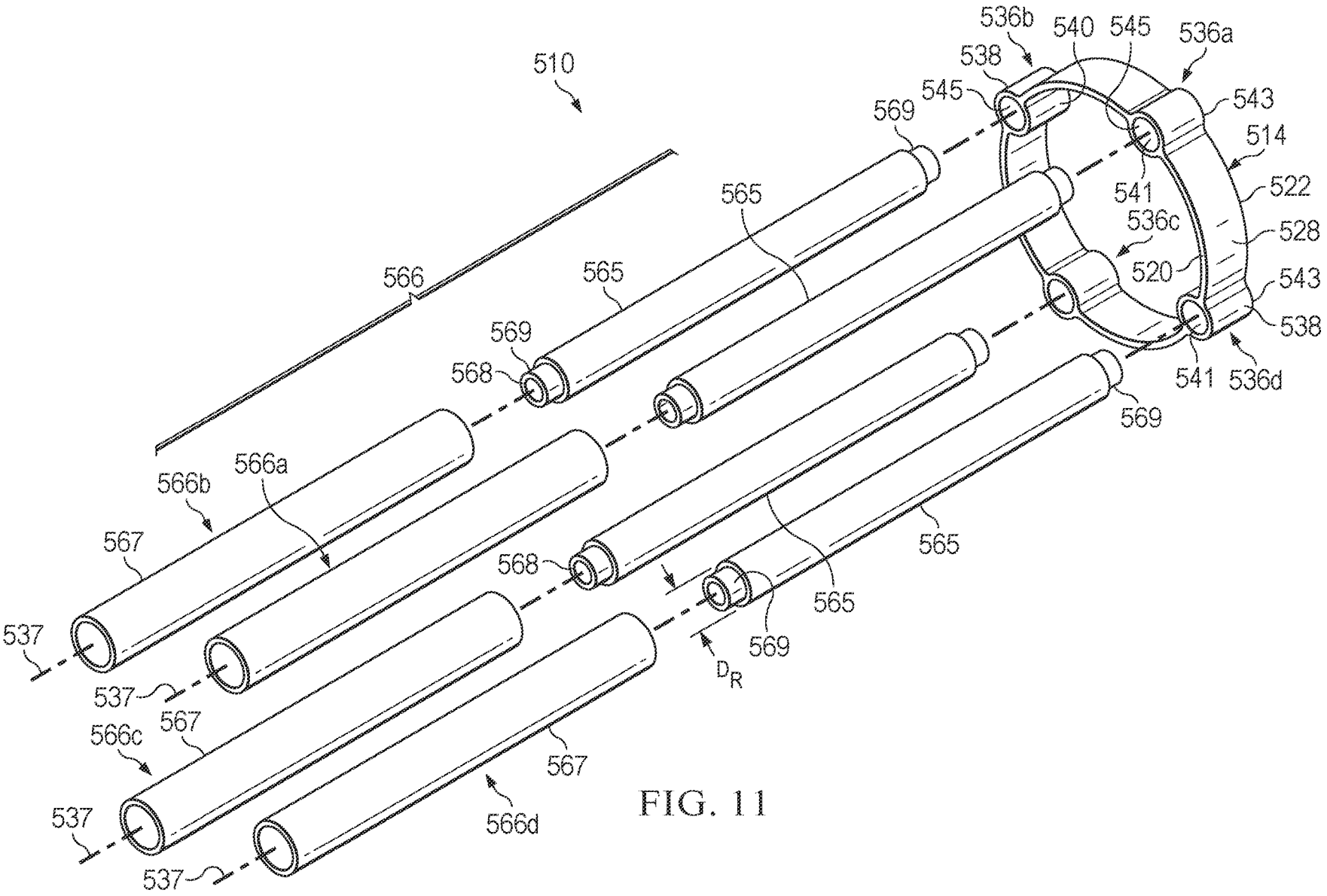
FIG. 11 is an elevational view of a third embodiment of a centralizer.
Figure 12:
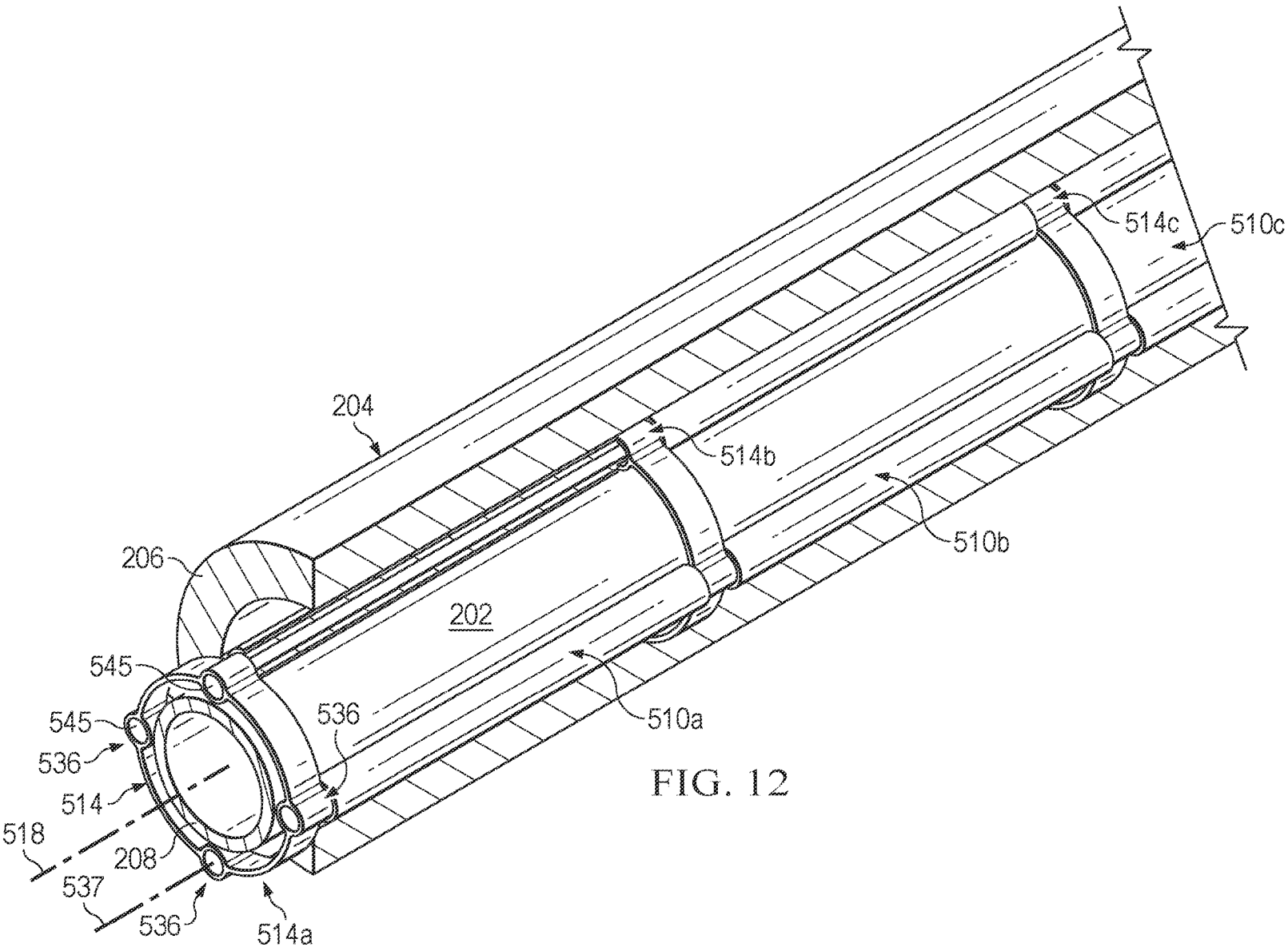
FIG. 12 is a cut-away elevational view of a plurality of the centralizers shown in FIG. 11 coupled together within a drill collar and supporting a sonde.
Figure 13:
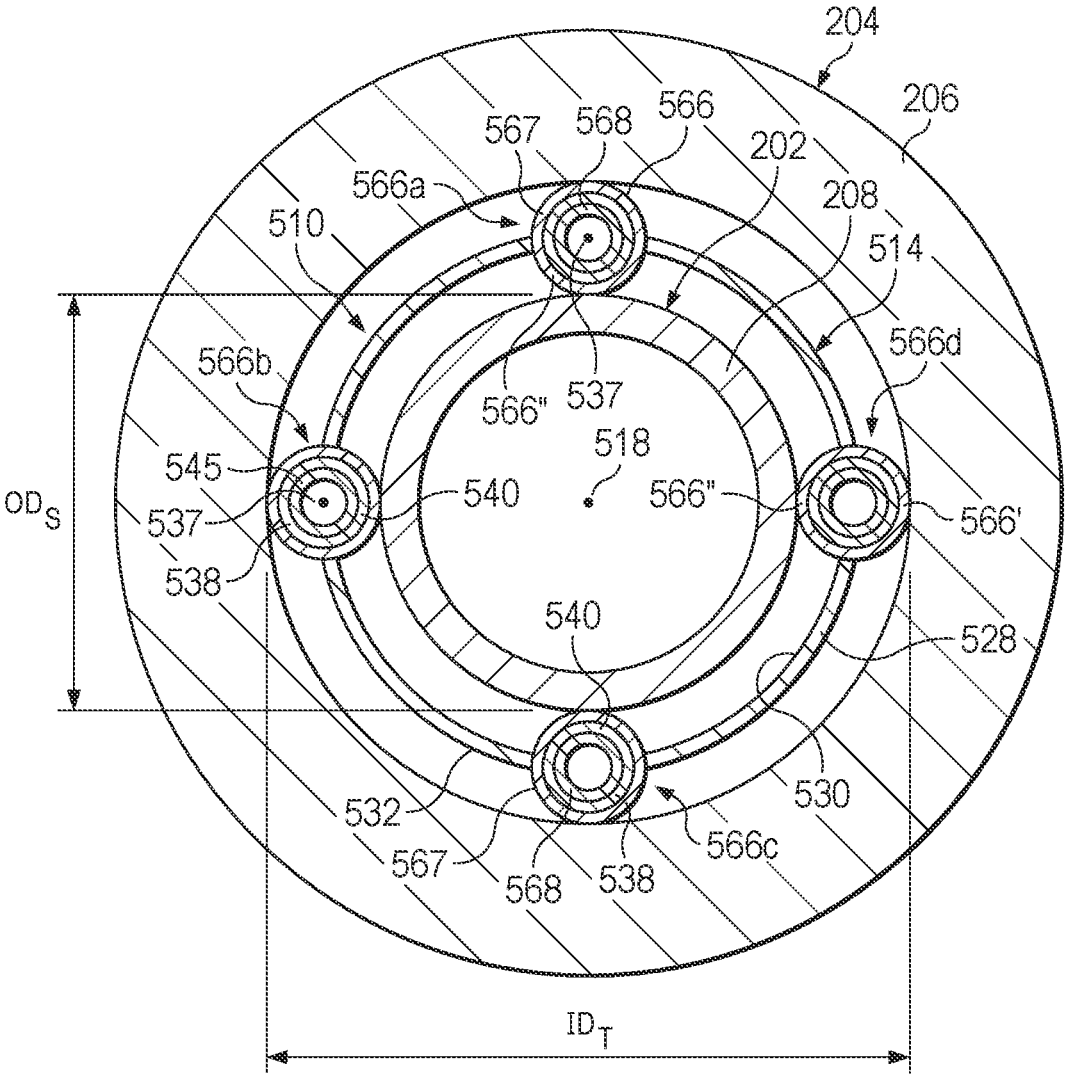
FIG. 13 is a planar, cross-sectional view of the centralizer and couplers of FIG. 12 supporting a sonde within a drill collar.

Turning to FIGS. 11-13, a centralizer 510 is shown where centralizer 510 supports a sonde 202 within a tubular 204. Centralizer 510 is formed of a primary tubular member 514 disposed about a centralizer axis 518 and having a first end 520 and a second end 522. A tubular wall 528 extends between the first end 520 and second end 520. Tubular wall 528 has an inner surface 530 and an outer surface 532.

Although not limited to a particular shape, in one or more embodiments, primary tubular member 514 is circular in cross section. It will be appreciated that in other embodiments, primary tubular member 514 may have other shapes, such as polygonal in cross section, with at least three sides.

Three or more centralizer strip assemblies 536 extend along at least a portion of the primary tubular member 514. In the illustrated embodiment, four centralizer strip assemblies 536*a*, 536*b*, 536*c* and 536*d* are shown. In one or more embodiments, each centralizer strip assembly 536 is substantially linear and parallel to centralizer axis 518. In one or more embodiments, the three or more strip assemblies 536 may be symmetrically spaced from one another about tubular wall 528.

Each centralizer strip assembly 536 has a first end 541 and a second end 543. In addition, each centralizer strip assembly 536 has an outer portion 538 and an inner portion 540. Each of the outer portion 538 and an inner portion 540 of centralizer strip assembly 536 may be integrally formed with tubular wall 528. In one or more embodiments, the inner portion 540 and outer portion 538 are formed on opposite sides of wall 528, with inner portion 540 formed along the inner surface 530 of wall 528 and outer portion 538 formed along the outer surface 532 of wall 528 so that centralizer strip assembly 336 extends along a strip assembly axis 537 that is generally parallel to centralizer axis 518 for at least a portion of the length of tubular wall 528 between the first and second ends 520, 522 of tubular member 214.

In one or more embodiments, outer portion 538 and inner portion 540 of centralizer strip assembly 536 may be generally symmetrical, of the same shape and dimension. In this regard, outer portion 538 and inner portion 540 may each be arcuate in cross-sectional shape so that together each centralizer strip assembly 536 is circular in shape. In one or more embodiments, a seat 545 may be formed at one or both ends 541, 543 of centralizer strip assembly 536. Where outer portion 538 and inner portion 540 are spaced apart from one another, seat 545 may be formed of a hollow open end of centralizer strip assembly 536, such as is shown in FIG. 11. In one or more embodiments, the hollow open end may be threaded with internal threads (not shown) or include other engagement mechanisms. In other embodiments, a seat 545 may be a pin or other projection (not shown) extending from one or both ends 541, 543 of centralizer strip assembly 536.

Centralizer 510 also includes three or more elongated connecting rod assemblies 566 engaged with primary tubular member 514 via strip assemblies 536. Each connecting rod assembly 566 is formed of a secondary tubular 565 having an outer rod diameter $D_R$. In one or more embodiments, each strip assembly 536 is engaged by a connecting rod assembly 566, and thus, the number of connecting rod assemblies 566 corresponds with the number of strip assemblies 536. In the illustrated embodiment, four connecting rod assemblies 566*a*, 566*b*, 566*c*, 566*d* are shown engaging the four strip assemblies 536*a*, 53*b*, 536*c*, 536*d*. Specifically, each secondary tubular 565 may include an end 568 that engages a seat 545 of the centralizer strip assembly 536 so that connecting rod assembly 566 extends along the corresponding strip assembly axis 537. Specifically, a portion 569 of end 568 may be shaped to engage seat 545. Where seat 545 is threaded as described above, portion 569 of end 568 of secondary tubular 565 may likewise be threaded for securing rod assembly 566 in centralizer strip assembly 536. Where a connecting rod assembly 566 is positioned between two primary tubular members 514, each portion 569 of end 568 of a connecting rod assembly 566 may be threaded or include an engagement mechanism for coupling with a seat 545. In one or more embodiments, portion 569 of end 568 of a connecting rod assembly 566 may be a pin or other projection disposed at end 568. In one or more embodiments, portion 569 of end 568 of rod assembly 566 may have a smaller outer diameter than outer rod diameter $D_R$, which smaller diameter portion 569 is disposed to engage a seat 545 of a centralizer strip assembly 536.

Connecting rod assembly 566 is not limited to a particular shape, but may have a circular cross-section in some embodiments. Likewise, connecting rod assembly 566 may be hollow or solid.

Secondary tubular 565 is not limited to a particular material, but may be fabricated of metal in one or more embodiments.

In one or more embodiments, connecting rod assembly 566 may also include a pliant or elastically deformable sheath 567 disposed on secondary tubular 565 to enhance engagement with sonde 202 and tubular 204. Sheath 567 may be an elastomeric material, including but not limited to rubber. In addition to enhancing engagement with the sonde 202 and tubular 204, sheath 567 may also protect secondary tubular 565, particularly where it is fabricated of metal.

As best seen in FIG. 12, in one or more embodiments, successive centralizers 510, such as centralizers 510*a*, 510*b* and 510*c* may be deployed where the connecting rod assemblies 566 of one centralizer 510 engage the primary tubular member 514 of a successive centralizer 510.

As best seen in FIG. 13, when centralizers 510 are deployed within a tubular 204, an outer portion 566' of each connecting rod assembly 566 engages the wall 206 of tubular 204 at its tubular inner diameter $ID_T$, and an inner portion 566" of each connecting rod assembly 566 engages wall 208 of sonde 202 at its sonde outer diameter $OD_S$. In one or more embodiments, the sheath 567 includes outer portion 566' and inner portion 566" such that sheath 567 engages each of tubular 204 and sonde 202. The elasticity of sheath 567 permits centralizer 510 to have an interference fit within tubular 20 and sonde 202 to have an interference fit within centralizer 510 in order to limit relative movement between centralizer 510, sonde 202 and tubular 204.

Figure 14:
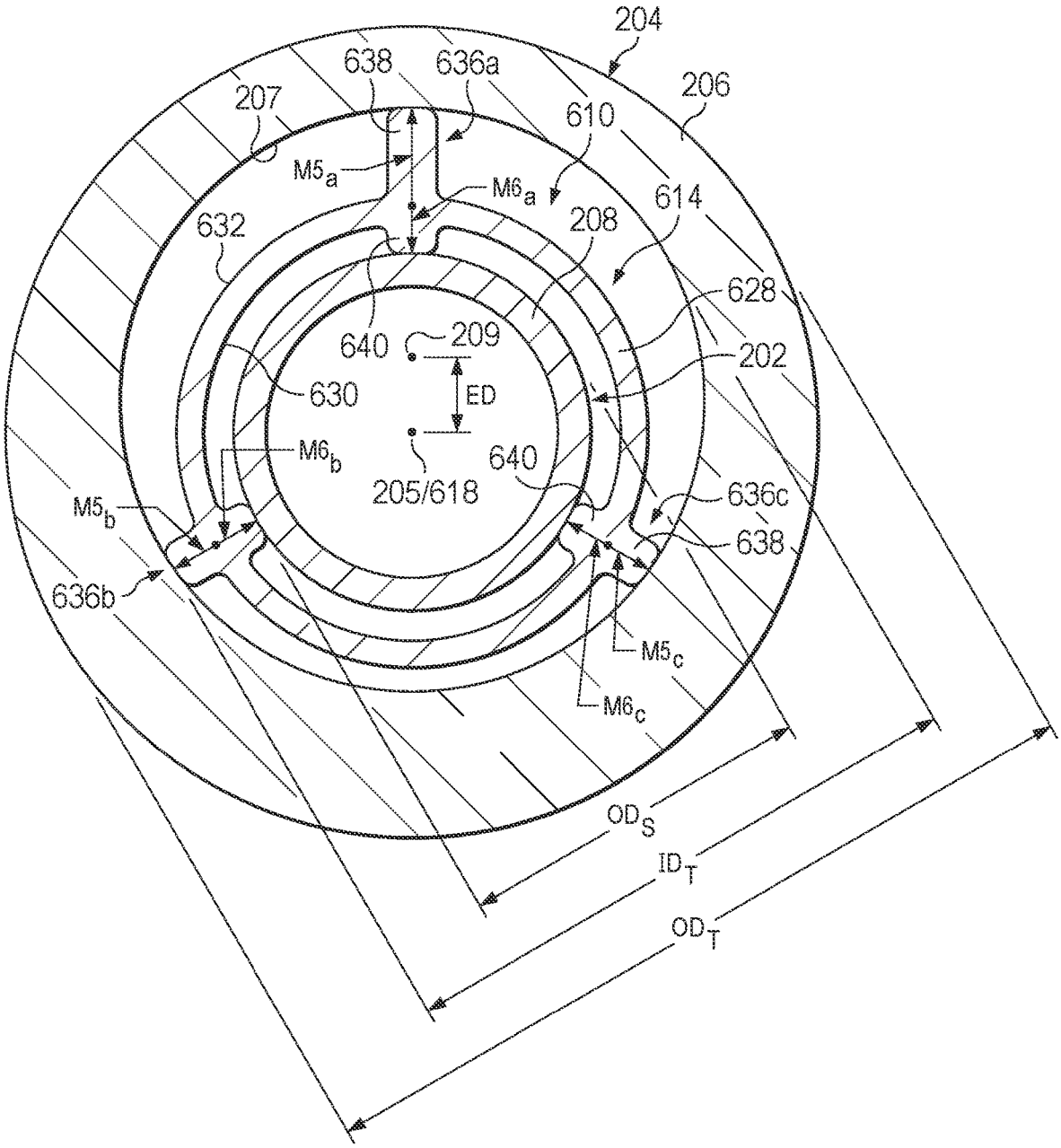
FIGS. 14 and 15 are planar, cross-sectional views of a fourth embodiment of a centralizer supporting a sonde within a drill collar.
Figure 15:
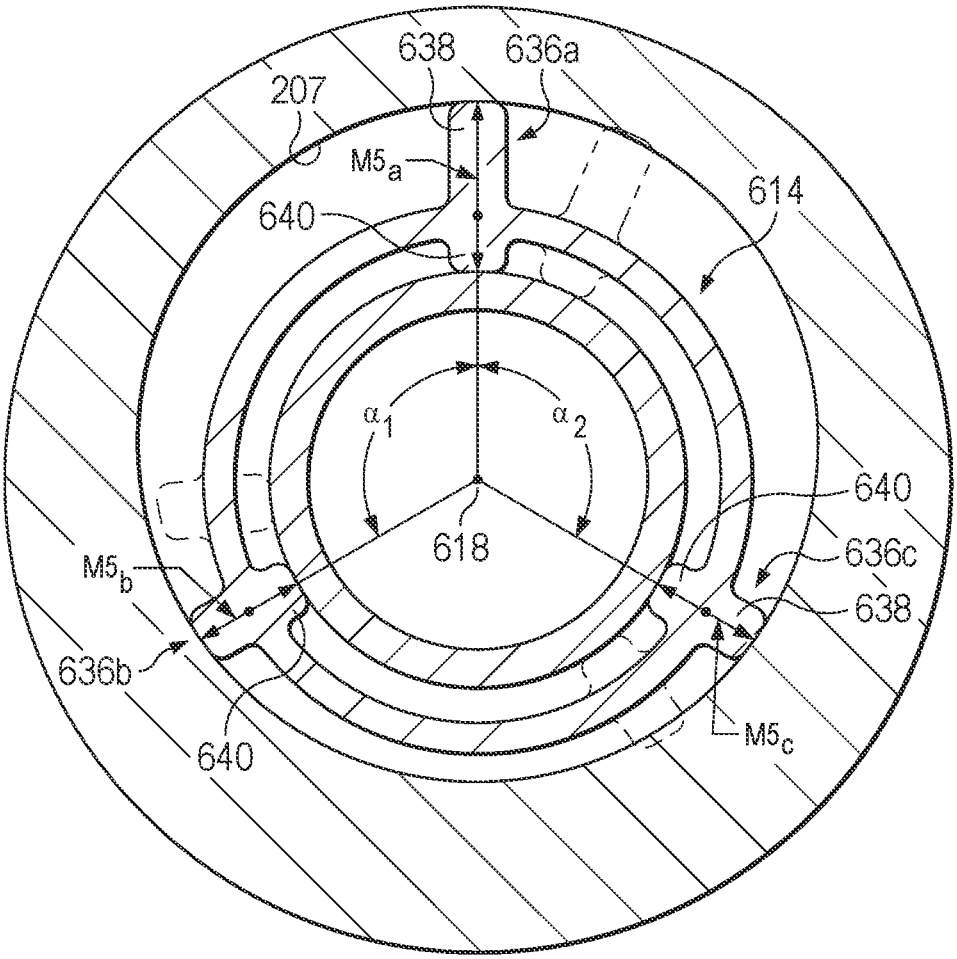
Figure 16:
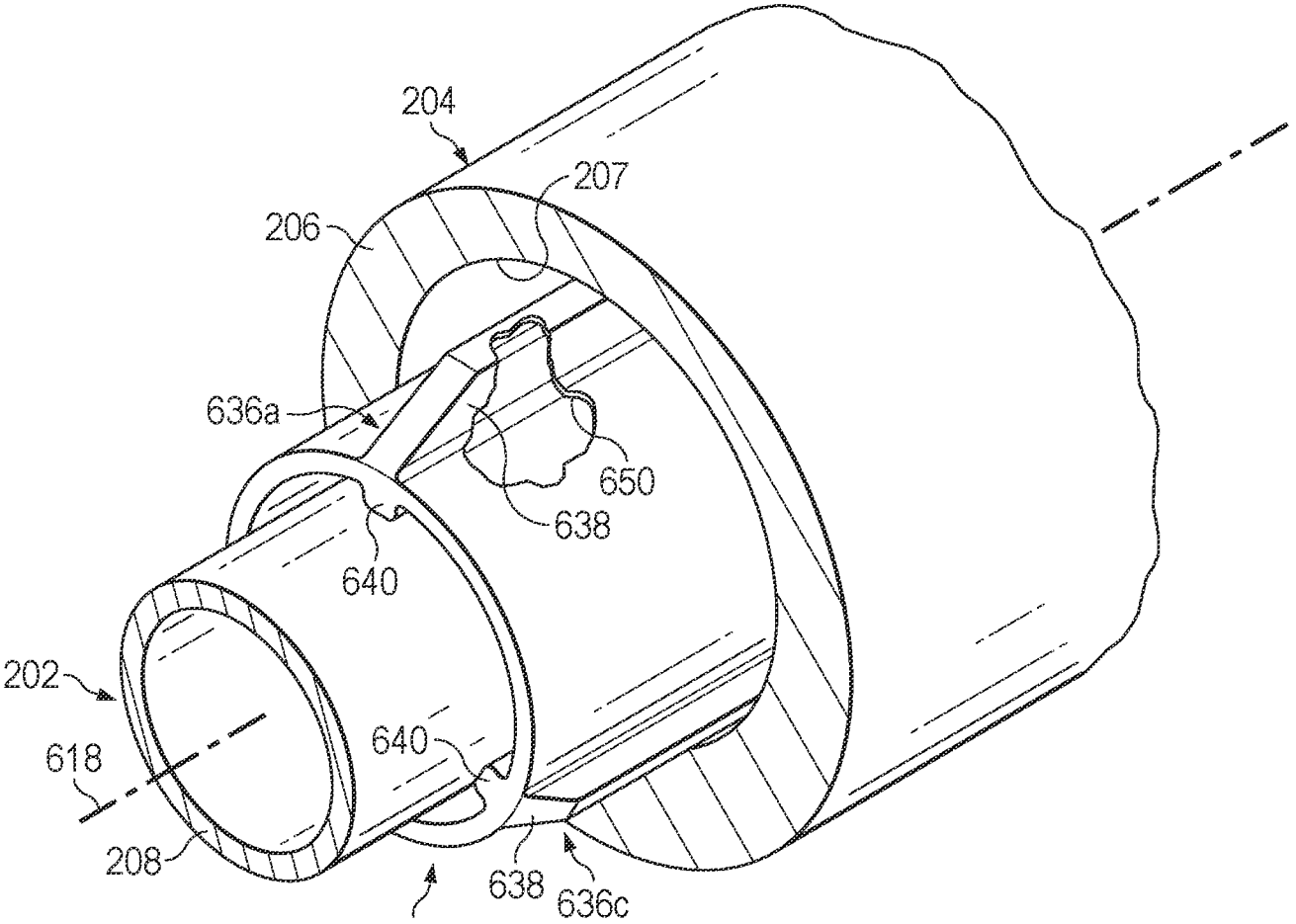
FIG. 16 is a cut-away elevational view of the centralizer shown in FIGS. 14 and 15 supporting a sonde within a drill collar.

Turning to FIGS. 14-16, a sonde 202 is shown supported within a tubular 204 by a centralizer 610. Tubular 204 may generally include a tubular wall 206 having a tubular outer diameter $OD_T$ where the tubular outer diameter $OD_T$ is concentric about a tubular axis 205. Tubular 204 also includes an eccentric inner bore 207 having a tubular inner diameter $ID_T$ and concentric about an eccentric axis 209 that is spaced apart from the tubular axis 205 by an eccentric offset distance ED. Sonde 202 as described herein is not limited to any particular type of sonde, but is likewise provided for illustrative purposes only. Sonde 202 may generally include a sonde tubular wall 208 having a sonde outer diameter $OD_S$.

It will be appreciated that centralizer 610 is particularly useful for ensuring concentric positioning of sonde 202 relative to tubular axis 205, which tubular axis 205 would also generally coincide with the central axis of a wellbore 108 and rotational axis of a drill string. Utilizing centralizer 610, sonde 202 is generally concentrically positioned with the wellbore 108, ensuring the directional sensors (not shown) in the sonde 202 coincide with the rotational axis of a drill string (not shown).

Centralizer 610 includes a primary tubular member 614 disposed about a centralizer axis 618 which centralizer axis 618 is generally coaxial with tubular axis 205 when centralizer 610 is disposed within a tubular 204. Primary tubular member 614 is formed of a tubular wall 628 having an inner surface 630 and an outer surface 632.

Three or more elongated centralizer strip assemblies 636 extend along at least a portion of the length of primary tubular member 614. In the illustrated embodiment, thee elongated centralizer strip assemblies 636*a*, 636*b*, 636*c* are shown. In one or more embodiments, each elongated centralizer strip assembly 636 is substantially linear and parallel to centralizer axis 618.

Each elongated centralizer strip assembly 636 has an outer portion 638 and an inner portion 640. Each of the outer portion 638 and an inner portion 640 of an elongated centralizer strip assembly 636 may be integrally formed with tubular wall 628. In one or more embodiments, the inner portion 640 and outer portion 638 are formed on opposite sides of wall 628, with inner portion 640 formed along the inner surface 630 of wall 628 and outer portion 638 formed along the outer surface 632 of wall 328 so that elongated centralizer strip assembly 636 extends along a strip assembly axis 637 that is generally parallel to centralizer axis 618 for at least a portion of the length of tubular wall 628. Each of the outer portion 638 and inner portion 640 of an elongated centralizer strip assembly 636 may be integrally formed with tubular wall 614.

Although not limited to a particular shape, in one or more embodiments, primary tubular member 614 is circular in cross section. Likewise, inner portion 640 and outer portion 638 are not limited to a particular shape. In one or more embodiments, one or both of inner portion 640 and outer portion 638 are fin shaped. In one or more embodiments, one or both of inner portion 640 and outer portion 638 are fins or blades. In one or more embodiments, one or both of inner portion 640 and outer portion 638 are protrusions that are triangular or semicircular in cross-sectional shape. In other embodiments, inner portion 640 may have a different shape than outer portion 638.

In one or more embodiments, regardless of the particular shape of any given elongated strip assembly 636, the outer portion 638 of each elongated strip assembly 636 has an outer radial length M5 and the inner portion 640 of each elongated strip assembly 636 has an inner radial length M6.

In one or more embodiments, the outer radial length M5 of one elongated centralizer strip assembly 636, designated the reference strip assembly, is longer than the outer radial lengths M5 of the other elongated centralizer strip assemblies 636. As such, the outer radial lengths M5 of at least two elongated centralizer strip assemblies 636 are different. For example, as illustrated in FIG. 14, the length $M5_a$ of strip assembly 636*a* is longer or greater than the length $M5_b$ of strip assembly 636*b*.

As such, strip assembly 636*a* is the reference strip assembly of centralizer 610.

Two or more strip assemblies 636 are spaced apart from the reference strip assembly, as well as each other, around the perimeter of primary tubular member 614. Where two strip assemblies 636 are spaced the same angular distance $\alpha$ from the primary strip assembly 636, then the two strip assemblies 636 will have the same length M5. For example, in FIG. 15, each of strip assemblies 636*b*, 636*c* may be angularly spaced apart or offset from primary strip assembly 636*a* an angular distance of 120 degrees such that angular distance $\alpha$1 is the same as angular distance $\alpha$2. In such case, outer radial length $M5_b$ of elongated centralizer strip assembly 636*b* is the same as outer radial length $M5_c$ of elongated centralizer strip assembly 636*c*. In this embodiment, the strip assemblies 636 are symmetrically spaced about the perimeter of primary tubular member 614. In other embodiments, the angular distance $\alpha$ of two or more strip assemblies 636 from the primary strip assembly 636*a* may be different, in which case, the smaller the angular distance $\alpha$, the larger the outer radial length M5. Thus, in some embodiments, angular distance $\alpha$1 is less than angular distance $\alpha$2, in which case outer radial length $M5_b$ of elongated centralizer strip assembly 636*b* is greater than outer radial length $M5_c$ of elongated centralizer strip assembly 636*c*. In any event, angular distance $\alpha$ about centralizer axis 618 from the reference strip assembly determines the outer radial length M5. Where two strip assemblies 636 each have the same angular distance $\alpha$ of offset from primary strip assembly, then the router radial lengths M5 of the offset strip assemblies 636 will be the same. Where the angular distance $\alpha$ of offset of two strip assemblies differs, the greater the angular distance $\alpha$, the shorter the outer radial length M5.

Moreover, in one or more embodiments, the inner radial length M6 of each inner portion 640 of the elongated strip assemblies 636 is the same. Thus, for example, inner radial length $M6_a$ of elongated strip assembly 636*a* is the same as inner radial length $M6_b$ of elongated strip assembly 636*b* and inner radial length $M6_c$ of elongated strip assembly 636*c*. As such, a sonde 202 supported within primary tubular member 614 by inner portions 640 is concentric with primary tubular 614.

In one or more embodiments, the outer radial length M5 of one elongated centralizer strip assembly 636, designated the reference strip assembly, is longer than the outer radial lengths M5 of the other elongated centralizer strip assemblies 636. As such, the outer radial lengths M5 of at least two elongated centralizer strip assemblies 636 are different. For example, as illustrated in FIG. 14, the length $M5_a$ of strip assembly 636*a* is longer or greater than the length $M5_b$ of strip assembly 636*b*.

As such, strip assembly 636*a* is the reference strip assembly.

In any event, it will be appreciated that the outer radial length $M5_a$ of reference strip assembly 636*a* is selected so that centralizer axis 618 is coaxial with tubular axis 205, thereby ensuring that sonde 202 is concentric within tubular 204 relative to its tubular outer diameter $OD_T$.

It will be appreciated that centralizer 610 is particularly useful for ensuring concentric positioning of sonde 202 where tubular 204 has an eccentric inner bore 207.

While the above has been described with three strip assemblies 636, centralizer 610 may include an even or odd number of strip assemblies 636, which may be symmetrically or asymmetrically spaced about the perimeter primary tubular member 614.

As illustrated in FIG. 15 in ghost, a centralizer 610 with strip assemblies 636 as described will minimize radial rotation of sonde 202 within eccentric inner bore 207. The primary strip assembly and at least one of the angularly spaced strip assemblies will prevent such rotation to the extent centralizer 610 moves relative to tubular 204. Torsional vibration, including stick slip and high frequency torsional oscillation (HFTO) can be severe in certain drilling conditions, resulting in potential hardware damage, erroneous measurements, or exposure of sensors mounded inside the sonde to saturation. Centralizer 610 will function as a torsional vibration damper while maintaining the concentricity of sonde axis and drill string rotational axis.

As best seen in FIG. 16, in one or more embodiments, centralizer 610 may include an outer covering or sheath 650. In some embodiments, outer covering 650 may be an elastomeric overmold. The elastomeric overmold may be rubber. This is particularly desirable in those embodiments where one or more of the strip assemblies 636 and primary tubular member 614 are fabricated of metal. In other embodiments, particularly where centralizer 610 is integrally formed, strip assemblies 636 and primary tubular member 614 may be fabricated of the same non-metallic material.

Figure 17:
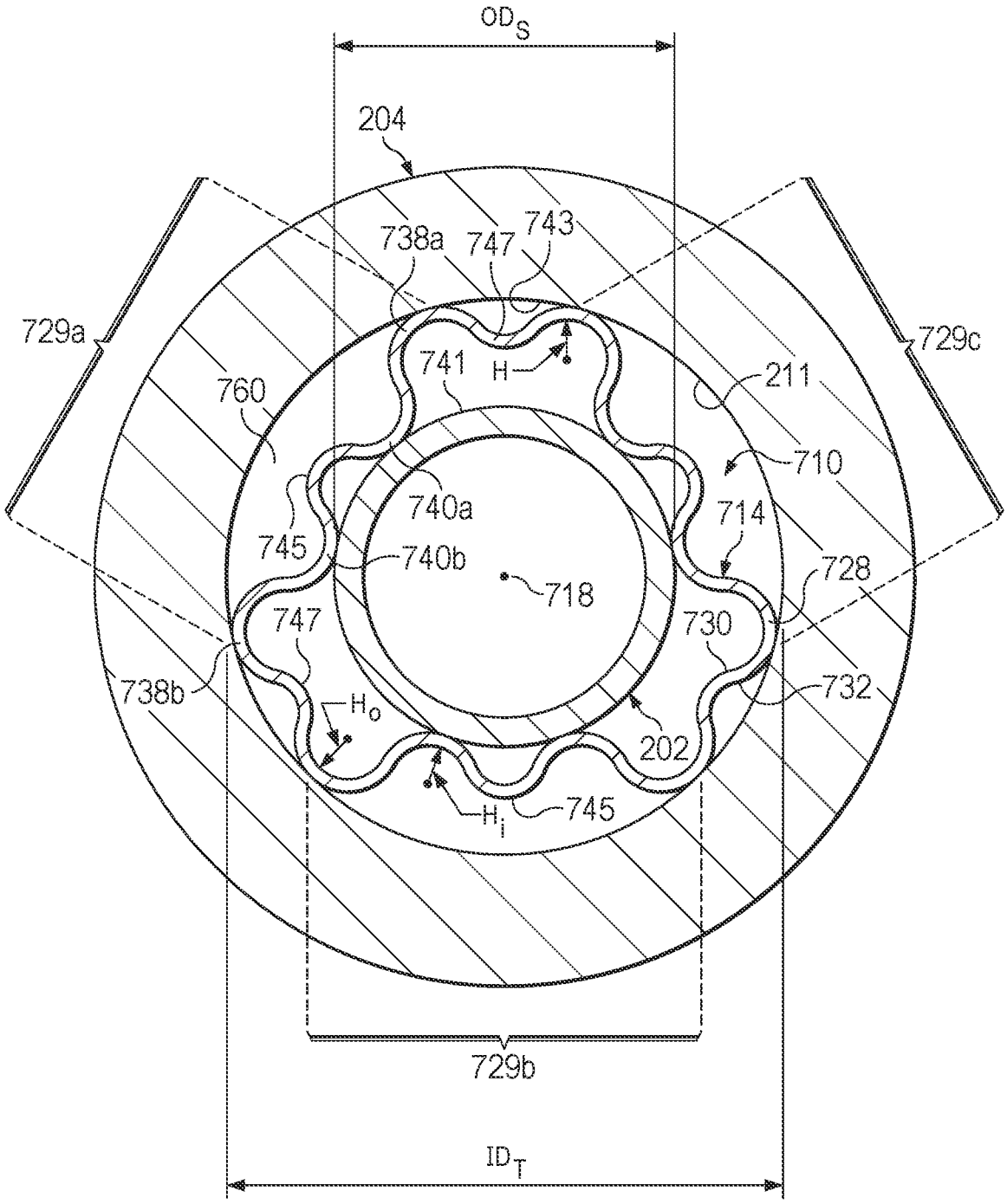
FIG. 17 is a planar, cross-sectional view of a fifth embodiment of a centralizer supporting a sonde within a drill collar.
Figure 18:
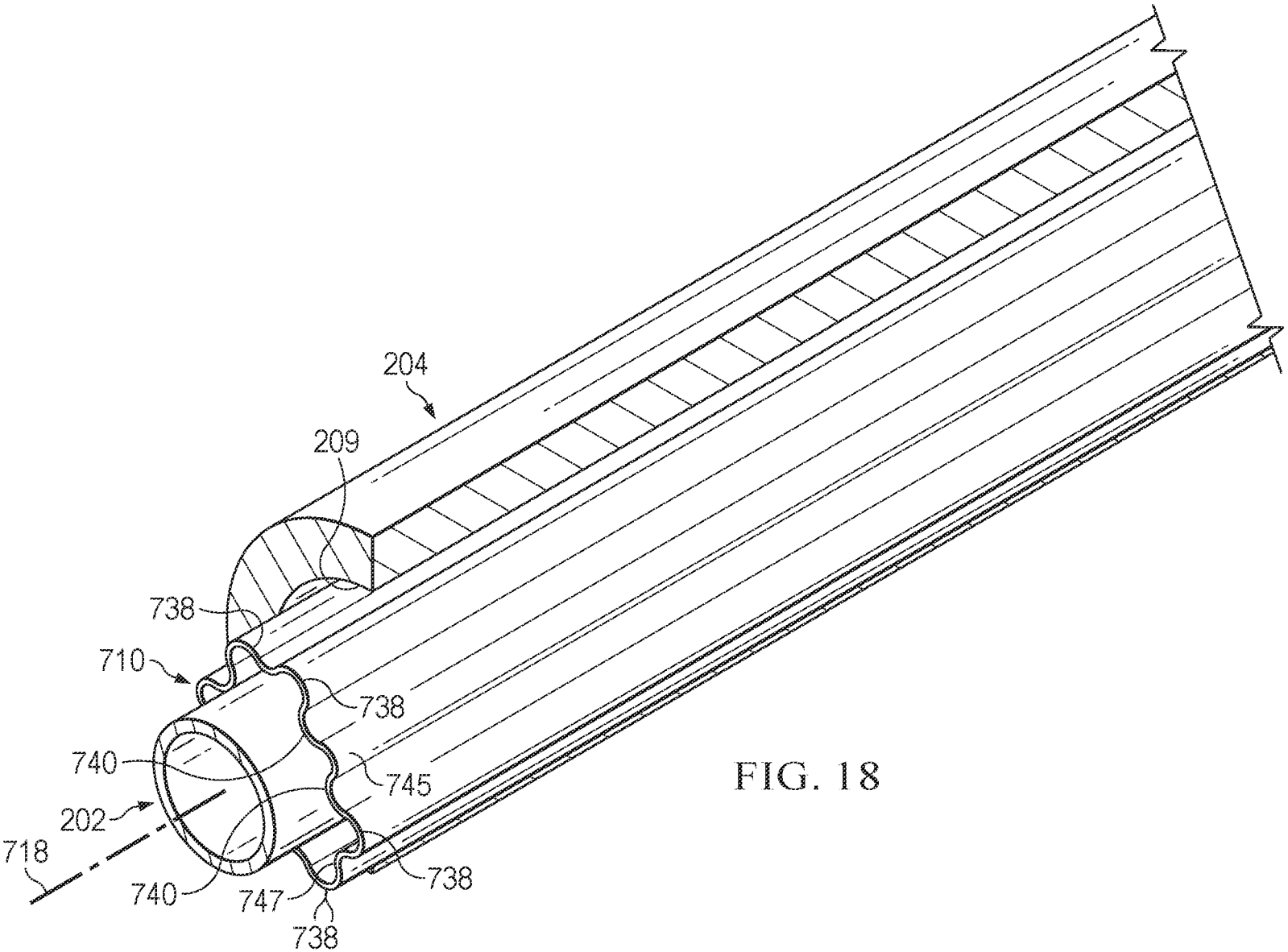
FIG. 18 is a cut-away elevational view of the centralizer shown in FIG. 17 supporting a sonde within a drill collar.

With reference to FIGS. 17 and 18, a centralizer 710 is illustrated supporting a sonde 202 within a tubular 204 having an inner wall 211. Centralizer 710 includes an elongated, primary tubular member 714 that is polygonal in cross-section and extends along a centralizer axis 718. Tubular member 714 is formed of a tubular wall 728 that has an inner surface 730 and an outer surface 732. Tubular wall 728, being polygonal in cross-section, has three or more sides 729. In the illustrated embodiment, tubular wall 728, has three sides 729*a*, 729*b* and 729*c*. Each side 729 has two adjacent inwardly extending ridges 740*a*, 740*b* positioned between two outwardly extending ridges 738*a*, 738*b*, where the inwardly extending ridges 740*a*, 740*b* each extend inward to an inner diameter 741 and the outwardly extending ridges 738*a*, 738*b* each extend outward to an outer diameter 743. The two adjacent inwardly extending ridges 740*a*, 740*b* of a side 729 are joined by an outward transition ridge 745 that is spaced apart from the outer diameter 743. Similarly, adjacent sides 729 of tubular member 714 are joined together by an inward transition ridge 747 that is spaced apart from the inner diameter 741. As such, outwardly extending ridges 738 of adjacent sides 729 are likewise adjacent one another. One or more of the ridges 738, 740, 745, 747 as described herein may be rounded at its apex. In other embodiments, each side may have a plurality of successive inwardly extending ridges 740 positioned between two outwardly extending ridges 738. While the illustrated embodiment shows two outwardly extending ridges 738 formed at the intersection of adjacent sides 729, such as 729*a* and 729*b*, in other embodiments, a single outwardly extending ridge 738 may be formed at the intersection of adjacent sides 729 with two or more inwardly extending ridges 740 formed along a side 729. Alternatively, yet in other embodiments, two or more outwardly extending ridge 738 may be formed at the intersection of adjacent sides 729, with one or more inwardly extending ridges 740 formed along a side 729.

In any event, as shown, in FIG. 17, by shaping tubular member 714 as described, the cross-sectional areas of flow passage 760 between the outwardly extending ridges 738*a*, 738*b* of a side 729 can be increased over traditional prior art centralizers that are simply formed of alternating inward and outward ridges. Moreover, the arrangement of two adjacent inwardly extending ridges 740*a*, 740*b* provides better contact compression on the sonde 202 than alternating inward and outward ridges. Likewise, the arrangement of two adjacent outwardly extending ridges 738 of intersecting sides 729 provides better contact compression against the inner wall 211 of the tubular 204 than alternating inward and outward ridges of the prior art.

In one or more embodiments, each inwardly extending ridge 740 and each outwardly extending ridge 738 may have a high or radius H. In one or more embodiments, the height $H_i$ of each inwardly extending ridge 740 is less than the height $H_o$ of each outwardly extending ridge 738, thereby permitting outwardly extending ridges 738 to better engage the larger inner diameter $ID_T$ of the tubular 204 and inwardly extending ridges 740 to better engage the smaller outer diameter $OD_S$ of the sonde 202. This also allows for increased flow area along flow path 760.

Figure 19:
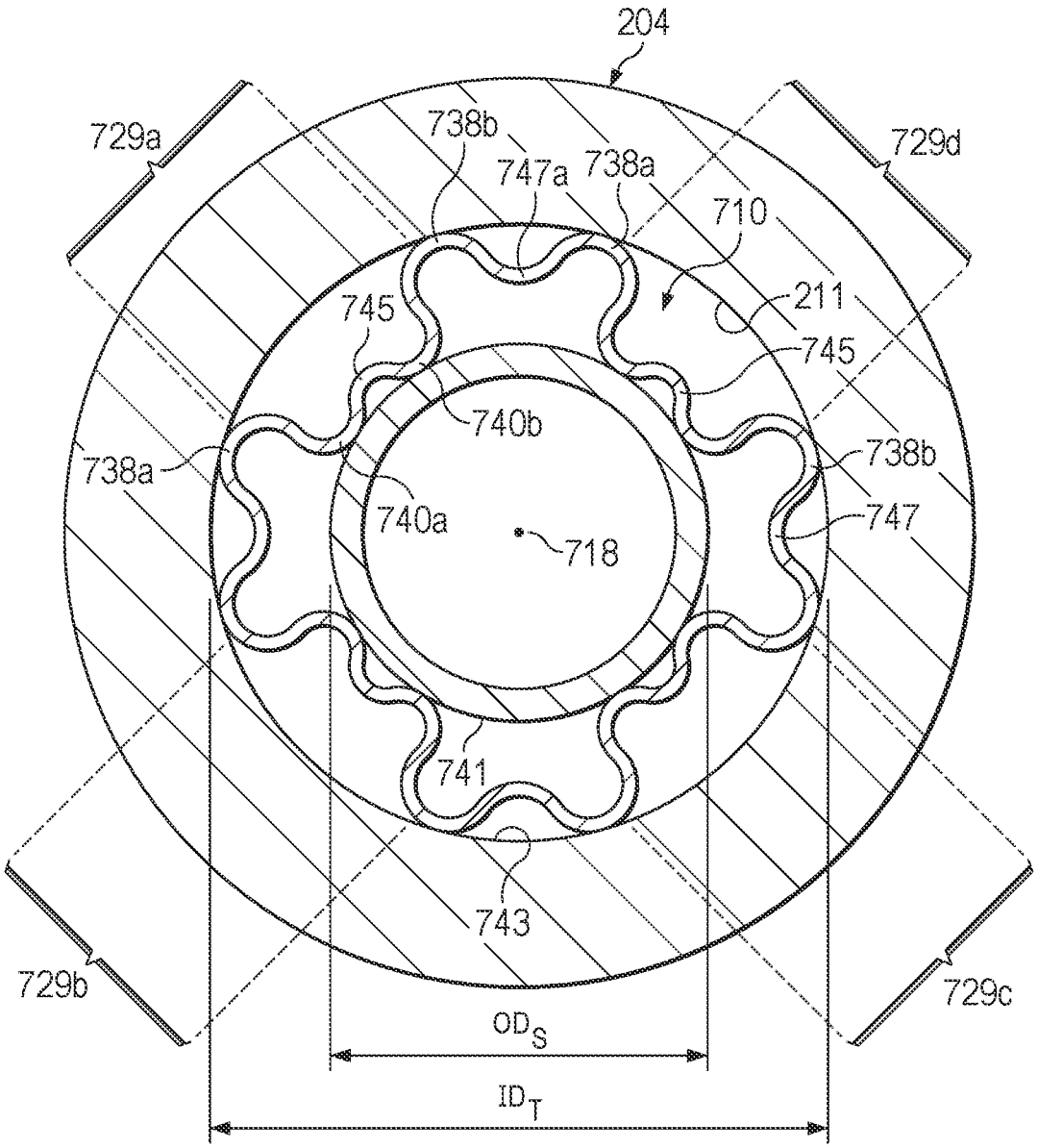
FIG. 19 is a planar, cross-sectional view of a sixth embodiment of a centralizer supporting a sonde within a drill collar.
Figure 20:
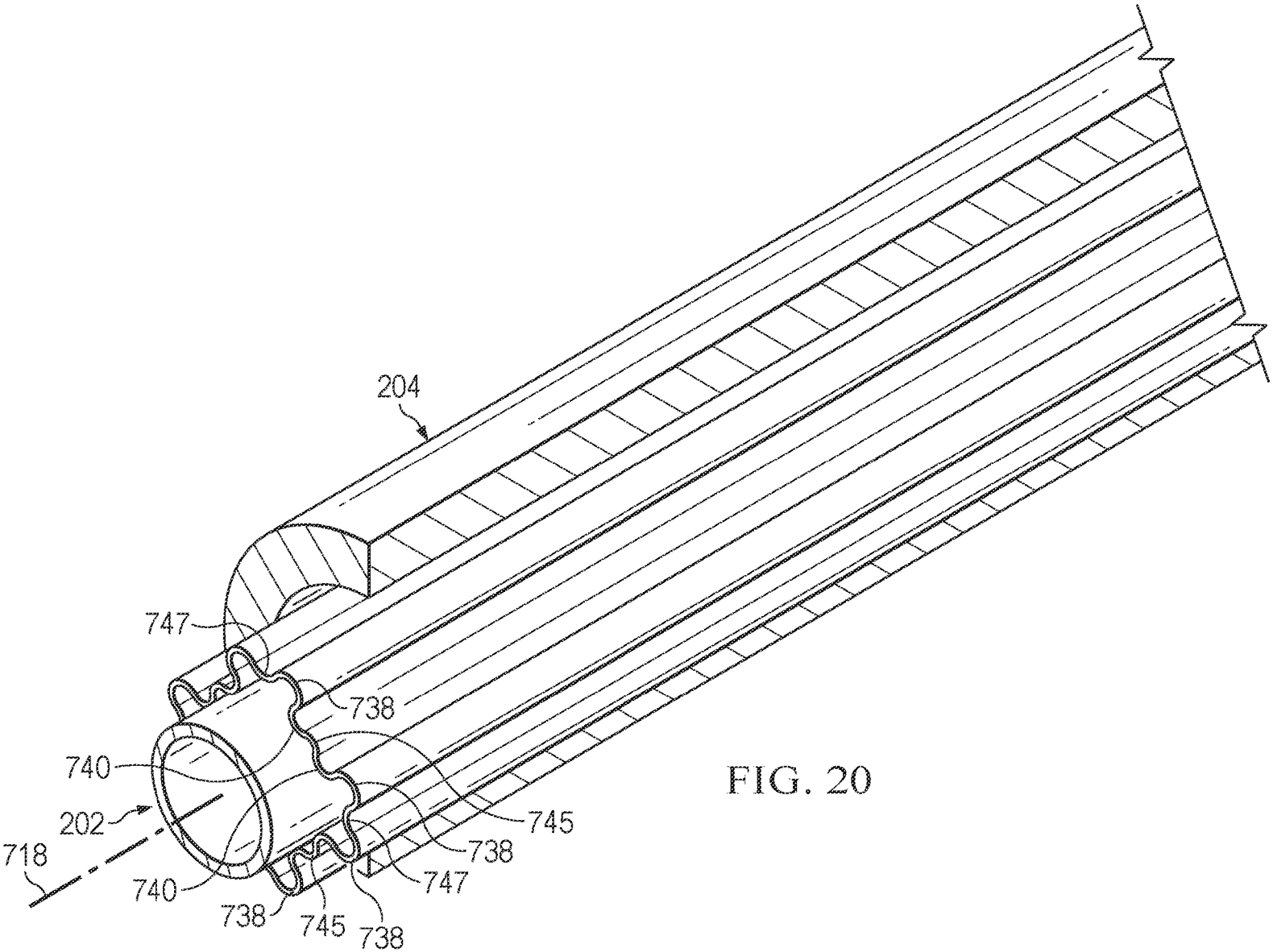
FIG. 20 is a cut-away elevational view of the centralizer shown in FIG. 19 supporting a sonde within a drill collar.

In FIGS. 19 and 20, centralizer 710 is illustrated as having four sides 729*a*, 729*b*, 729*c* and 729*d*. However, each of the four sides 729*a*, 729*b*, 729*c* and 729*d*, as with the embodiment of centralizer 710 shown in FIGS. 17 and 18, defines two adjacent inwardly extending ridges 740*a*, 740*b* positioned between two outwardly extending ridges 738*a*, 738*b*, where the inwardly extending ridges 740*a*, 740*b* each extend inward to an inner diameter 741 and the outwardly extending ridges 738*a*, 738*b* each extend outward to an outer diameter 743. The two adjacent inwardly extending ridges 740*a*, 740*b* of a side 729 are joined by an outward transition ridge 745 that is spaced apart from the outer diameter 743. Similarly, adjacent sides 729 of tubular member 714 are joined together by an inward transition ridge 747 that is spaced apart from the inner diameter 741. Thus, in FIGS. 19 and 20, four outward transition ridges 745*a*, 745*b*, 745*c* and 745*d* are shown. Likewise, four inward transition ridges 747*a*, 747*b*, 747*c* and 747*d* are shown.

Thus, various embodiments of a centralizer assembly for use in a wellbore has been described:

In one or more embodiments, the centralizer may include an elongated, primary tubular member extending along a centralizer axis, the primary tubular member having a first end and a second end and a tubular wall extending between the first and second ends, the tubular wall having an inner surface and an outer surface; and two or more elongated centralizer strip assemblies extending along at least a portion of the primary tubular member, wherein an outer portion of each centralizer strip assembly is adjacent the outer surface of the tubular wall and an inner portion of each centralizer strip assembly is adjacent the inner surface of the tubular wall so that the inner portion and outer portion of each centralizer strip assembly oppose one another on opposite sides of the tubular wall.

In one or more embodiments, the centralizer may include an elongated, primary tubular member extending along a centralizer axis, the primary tubular member having a first end and a second end and a tubular wall extending between the first and second ends, the tubular wall having an inner surface and an outer surface; and at least three linear centralizer strip assemblies spaced apart from one another about a circumference of the primary tubular member, each linear centralizer strip assembly extending from adjacent the first end of the primary tubular member to adjacent the second end of the primary tubular member, each centralizer strip assembly being substantially parallel with the centralizer axis, wherein an outer portion of each centralizer strip assembly is adjacent the outer surface of the tubular wall and an inner portion of each centralizer strip assembly is adjacent the inner surface of the tubular wall so that the inner portion and outer portion of each centralizer strip assembly oppose one another on opposite sides of the tubular wall; wherein the inner portion and outer portion of each centralizer strip assembly is formed of an elastomer.

In one or more embodiments, the centralizer may include an elongated, primary tubular member extending along a centralizer axis, the primary tubular member having a first end and a second end and a tubular wall extending between the first and second ends, the tubular wall having an inner surface and an outer surface; and two or more elongated centralizer strip assemblies extending along at least a portion of the primary tubular member, wherein an outer portion of each centralizer strip assembly is adjacent the outer surface of the tubular wall and an inner portion of each centralizer strip assembly is adjacent the inner surface of the tubular wall so that the inner portion and outer portion of each centralizer strip assembly oppose one another on opposite sides of the tubular wall; wherein each strip assembly is hollow in cross-section.

In one or more embodiments, the centralizer may include a first elongated, primary tubular member that is circular in cross-section and extending along a centralizer axis, the primary tubular member having a first end and a second end and a tubular wall extending between the first and second ends, the tubular wall having an inner surface and an outer surface; and at least three centralizer strip assemblies symmetrically spaced about a perimeter of the first primary tubular, wherein each elongated centralizer strip assembly extends along at least a portion of the length of the primary tubular member, wherein each strip assembly has an arcuate shaped outer portion integrally formed in the tubular wall adjacent the outer surface of the tubular wall and an arcuate shaped inner portion integrally formed in the tubular wall adjacent the inner surface of the tubular wall so that the inner portion and outer portion of each centralizer strip assembly oppose one another on opposite sides of the tubular wall so that the opposing inner portion and outer portion of each centralizer strip assembly together form a secondary elongated tubular of hollow cross-section.

In one or more embodiments, the centralizer may include a first primary tubular member formed about a centralizer axis, the first primary tubular member having a first end and a second end and a tubular wall extending between the first and second ends, the tubular wall having an inner surface and an outer surface; three or more first centralizer strip assemblies extending along at least a portion of the first primary tubular member and spaced apart from one another about a circumference of the first primary tubular member, wherein each first strip assembly has a first end and a second end, and an outer portion of adjacent the outer surface of the tubular wall and an inner portion adjacent the inner surface of the tubular wall so that the inner portion and outer portion of each first centralizer strip assembly oppose one another forming a seat at each of the first end and second end of the first strip assembly; and three or more elongated first connecting rod assemblies, each first connecting rod assembly having a first end and a second end and extending an axis parallel with the centralizer axis, where the first end of each first connecting rod assembly is engaged with a seat of a first centralizer strip assembly.

In one or more embodiments, the centralizer may include a first elongated, primary tubular member that is polygonal in cross-section with at least three tubular walls forming the primary tubular and extending along a centralizer axis, where adjacent tubular walls join together at an intersection, the primary tubular member having a first end and a second end with the tubular walls extending between the first and second ends, each tubular wall having an inner surface and an outer surface; and a centralizer strip assembly formed by adjacent walls at each intersection, wherein each elongated centralizer strip assembly extends along at least a portion of the length of the primary tubular member, wherein each strip assembly has an outer portion integrally formed in the tubular walls adjacent the outer surface of the tubular walls and an inner portion integrally formed in the tubular walls adjacent the inner surface of the tubular walls so that the inner portion and outer portion of each centralizer strip assembly are spaced apart from one another, wherein the outer portion of the strip assembly comprises a flexible outer spring, and wherein the inner portion of the strip assembly comprises an inner spring formed of a first inwardly depending leaf and a second inwardly depending leaf.

In one or more embodiments, the centralizer may include a first primary tubular member formed about a centralizer axis, the first primary tubular member having a first end and a second end and a tubular wall extending between the first and second ends, the tubular wall having an inner surface and an outer surface; three or more first centralizer strip assemblies extending along at least a portion of the first primary tubular member and spaced apart from one another about a circumference of the first primary tubular member, wherein each first strip assembly has a first end and a second end, and an outer portion of adjacent the outer surface of the tubular wall and an inner portion adjacent the inner surface of the tubular wall so that the inner portion and outer portion of each first centralizer strip assembly oppose one another forming a seat at each of the first end and second end of the first strip assembly; three or more elongated first connecting rod assemblies, each first connecting rod assembly having a first end and a second end and extending an axis parallel with the centralizer axis, where the first end of each first connecting rod assembly is engaged with a seat of a first centralizer strip assembly; and three or more elongated second connecting rod assemblies, each second connecting rod assembly having a first end and a second end and extending an axis parallel with the centralizer axis, wherein the second end of each second connecting rod assembly is engaged with a seat at the second end of a first centralizer strip assembly.

In one or more embodiments, the centralizer may include a first primary tubular member formed about a centralizer axis, the first primary tubular member having a first end and a second end and a tubular wall extending between the first and second ends, the tubular wall having an inner surface and an outer surface; three or more first centralizer strip assemblies extending along at least a portion of the first primary tubular member and spaced apart from one another about a circumference of the first primary tubular member, wherein each first strip assembly has a first end and a second end, and an outer portion of adjacent the outer surface of the tubular wall and an inner portion adjacent the inner surface of the tubular wall so that the inner portion and outer portion of each first centralizer strip assembly oppose one another forming a seat at each of the first end and second end of the first strip assembly; three or more elongated first connecting rod assemblies, each first connecting rod assembly having a first end and a second end and extending an axis parallel with the centralizer axis, where the first end of each first connecting rod assembly is engaged with a seat of a first centralizer strip assembly; a second primary tubular member formed about a centralizer axis, the second primary tubular member having a first end and a second end and a tubular wall extending between the first and second ends, the tubular wall having an inner surface and an outer surface; and three or more second centralizer strip assemblies extending along at least a portion of the second primary tubular member and spaced apart from one another about a circumference of the second primary tubular member, wherein each second strip assembly has a first end and a second end, and an outer portion of adjacent the outer surface of the tubular wall and an inner portion adjacent the inner surface of the tubular wall so that the inner portion and outer portion of each second centralizer strip assembly oppose one another forming a seat at each of the first end and second end of the second strip assembly; wherein the second end of each first connecting rod assembly is engaged with a seat of a second centralizer strip assembly.

In one or more embodiments, the centralizer may include an elongated, primary tubular member extending along a centralizer axis, the primary tubular member having a first end and a second end and a tubular wall extending between the first and second ends, the tubular wall having an inner surface and an outer surface; and three or more elongated centralizer strip assemblies extending along at least a portion of the primary tubular member, wherein an outer portion of each centralizer strip assembly is adjacent the outer surface of the tubular wall and an inner portion of each centralizer strip assembly is adjacent the inner surface of the tubular wall so that the inner portion and outer portion of each centralizer strip assembly oppose one another on opposite sides of the tubular wall, wherein the outer portion of each elongated strip assembly has an outer radial length and the inner portion of each elongated strip assembly has an inner radial length, and wherein the outer radial length of one elongated centralizer strip assembly of the three or more elongated centralizer strip assemblies is longer than the outer radial lengths of the other elongated centralizer strip assemblies.

In one or more embodiments, the centralizer may include an elongated, primary tubular member extending along a centralizer axis, the primary tubular member having a first end and a second end and a tubular wall extending between the first and second ends, the tubular wall having an inner surface and an outer surface; a first, second and third elongated centralizer strip assembly extending along at least a portion of the primary tubular member, wherein an outer portion of each centralizer strip assembly is adjacent the outer surface of the tubular wall and an inner portion of each centralizer strip assembly is adjacent the inner surface of the tubular wall so that the inner portion and outer portion of each centralizer strip assembly oppose one another on opposite sides of the tubular wall, wherein the outer portion of each elongated strip assembly has an outer radial length and the inner portion of each elongated strip assembly has an inner radial length, and wherein the outer radial length of the first elongated centralizer strip assembly is longer than the outer radial lengths of the second and third elongated centralizer strip assemblies, and wherein the inner radial length of all of the centralizer strip assemblies is the same.

In one or more embodiments, the centralizer may include an elongated, primary tubular member extending along a centralizer axis, the primary tubular member having a first end and a second end and a tubular wall extending between the first and second ends, the tubular wall having an inner surface and an outer surface; a first elongated centralizer strip assembly extending linearly along at least a portion of the primary tubular member so as to be parallel to the centralizer axis, the first elongated centralizer strip assembly having an outer portion adjacent the outer surface of the tubular wall and an inner portion adjacent the inner surface of the tubular wall where the inner portion and outer portion oppose one another on opposite sides of the tubular wall, the outer portion of the first elongated centralizer strip assembly having a first outer radial length and the inner portion of the first elongated centralizer strip assembly having a first inner radial length; a second elongated centralizer strip assembly spaced apart from the first elongated centralizer strip assembly about a perimeter of the elongated, primary tubular member, the second elongated centralizer strip assembly extending linearly along at least a portion of the primary tubular member so as to be parallel to the centralizer axis, the second elongated centralizer strip assembly having an outer portion adjacent the outer surface of the tubular wall and an inner portion adjacent the inner surface of the tubular wall where the inner portion and outer portion oppose one another on opposite sides of the tubular wall, the outer portion of the second elongated centralizer strip assembly having a second outer radial length and the inner portion of the second elongated centralizer strip assembly having a second inner radial length; and a third elongated centralizer strip assembly spaced apart from the first elongated centralizer strip assembly and the second elongated strip assembly about the perimeter of the elongated, primary tubular member, the third elongated centralizer strip assembly extending linearly along at least a portion of the primary tubular member so as to be parallel to the centralizer axis, the third elongated centralizer strip assembly having an outer portion adjacent the outer surface of the tubular wall and an inner portion adjacent the inner surface of the tubular wall where the inner portion and outer portion oppose one another on opposite sides of the tubular wall, the outer portion of the third elongated centralizer strip assembly having a third outer radial length and the inner portion of the third elongated centralizer strip assembly having a third inner radial length; wherein the first outer radial length is greater than the second outer radial length and the third outer radial length; and wherein the first, second and third inner radial lengths are the same.

In one or more embodiments, the centralizer may include an elongated, primary tubular member extending along a centralizer axis and having a first end and a second end with a tubular wall extending between the first and second ends, the tubular wall having an inner surface and an outer surface, wherein the primary tubular member is polygonal in cross-section such that tubular wall is formed with at least three sides; wherein each side has two adjacent inwardly extending ridges positioned between two outwardly extending ridges, the inwardly extending ridges each extend inward to an inner diameter and the outwardly extending ridges each extend outward to an outer diameter.

In one or more embodiments, the centralizer may include an elongated, primary tubular member extending along a centralizer axis and having a first end and a second end with a tubular wall extending between the first and second ends, the tubular wall having an inner surface and an outer surface, wherein the primary tubular member is polygonal in cross-section such that tubular wall is formed with at least three sides; and at least three outwardly extending ridges formed by the wall and a plurality of inwardly extending ridges formed by the wall, wherein positioned between two outwardly extending ridges are at least two inwardly extending ridges, the inwardly extending ridges each extend inward to an inner diameter and the outwardly extending ridges each extend outward to an outer diameter.

In one or more embodiments, the centralizer may include an elongated, primary tubular member extending along a centralizer axis and having a first end and a second end with a tubular wall extending between the first and second ends, the tubular wall having an inner surface and an outer surface, wherein the primary tubular member is polygonal in cross-section such that tubular wall is formed with at least three sides; at least three inwardly extending ridges formed by the wall and a plurality of outwardly extending ridges formed by the wall, wherein at least two outwardly extending ridges are positioned between two inwardly extending ridges, the inwardly extending ridges each extend inward to an inner diameter and the outwardly extending ridges each extend outward to an outer diameter.

The foregoing embodiments of a centralizer assembly may include one or more of the following elements alone or in combination with other elements:

The centralizer assembly of any example, wherein the inner portion and outer portion of each centralizer strip assembly is formed of an elastomer.

The centralizer assembly of any example, wherein each centralizer strip assembly is mounted in at least one perforation formed in the tubular wall.

The centralizer assembly of any example, wherein each centralizer strip assembly is integrally formed along the tubular wall.

The centralizer assembly of any example, wherein the inner portion and outer portion of each centralizer strip assembly are bonded to one another through the perforation.

The centralizer assembly of any example, further comprising three or more centralizer strip assemblies, wherein the centralizer strip assemblies are symmetrically spaced from one another about a periphery of the primary tubular member.

The centralizer assembly of any example, wherein the inner portion and outer portion of each centralizer strip assembly is solid in cross section.

The centralizer assembly of any example, wherein the primary tubular member has at least three sets of axially extending slots formed in the tubular wall, each set of slots radially spaced apart from the other sets of slots and each set of slots comprising a plurality of axially spaced apart slots.

The centralizer assembly of any example, further comprising a set of aligned, spaced apart perforations extending between the first and second ends of the primary tubular;

wherein a centralizer strip assembly is mounted in the set of perforations.

The centralizer assembly of any example, wherein the set of perforations are axially extending slots.

The centralizer assembly of any example, further comprising at least three linear centralizer strip assemblies spaced apart from one another and extending from adjacent the first end of the primary tubular to adjacent the second end of the primary tubular, each centralizer strip assembly being substantially parallel with the centralizer axis, wherein the inner portion and outer portion of each centralizer strip assembly is formed of an elastomer; and at least three sets of aligned, spaced apart perforations formed in the tubular wall and extending between the first and second ends of the primary tubular, wherein a centralizer strip assembly is mounted in each set of perforations; and wherein each centralizer strip assembly is integrally formed along the tubular wall such that the inner portion and outer portion of each centralizer strip assembly are bonded to one another through a set of perforations.

The centralizer assembly of any example, wherein the primary tubular is metal.

The centralizer assembly of any example, further comprising an elastomeric overholding encasing the primary tubular.

The centralizer assembly of any example, wherein the primary tubular further comprises a notch formed in in the tubular wall at the first end of the primary tubular and a finger extending from the tubular wall at the second end of the primary tubular.

The centralizer assembly of any example, wherein each notch and each finger have corresponding shapes.

The centralizer assembly of any example, wherein the inner portion and outer portion of each centralizer strip assembly is solid in cross section.

The centralizer assembly of any example, wherein the inner portion and outer portion of each centralizer strip assembly is hollow in cross section.

The centralizer assembly of any example, wherein the primary tubular member has at least three sets of axially extending slots formed in the tubular wall, each set of slots radially spaced apart from the other sets of slots and each set of slots comprising a plurality of axially spaced apart slots.

The centralizer assembly of any example, wherein the inner portion and outer portion of each centralizer strip assembly are attached to one another through a set of slots.

The centralizer assembly of any example, wherein the inner portion and out portion of each strip assembly are arcuate in cross-sectional shape so that the opposing inner portion and outer portion of each centralizer strip assembly together form a secondary elongated tubular.

The centralizer assembly of any example, wherein the inner portion and out portion of each centralizer strip assembly are integrally formed with the tubular wall.

The centralizer assembly of any example, wherein each centralizer strip assembly is linear and substantially parallel with the centralizer axis.

The centralizer assembly of any example, wherein the primary tubular is circular in cross section.

The centralizer assembly of any example, wherein the at least two or more centralizer strip assemblies comprises three centralizer strip assemblies symmetrically spaced about a perimeter of the primary tubular; and wherein the inner portion and out portion of each strip assembly are arcuate in cross-sectional shape and integrally formed with the tubular wall so that the opposing inner portion and outer portion of each centralizer strip assembly together form a secondary elongated tubular.

The centralizer assembly of any example, wherein the primary tubular is polygonal in cross section with at least three tubular walls forming the primary tubular, where adjacent walls join together at an intersection with a centralizer strip assembly formed at the intersection.

The centralizer assembly of any example, wherein each of the at least three tubular walls is arcuate in shape.

The centralizer assembly of any example, wherein the primary tubular is triangular in cross section.

The centralizer assembly of any example, wherein the outer portion of the strip assembly comprises a flexible outer spring.

The centralizer assembly of any example, wherein the inner portion of the strip assembly comprises an inner spring formed of a first inwardly depending leaf and a second inwardly depending leaf.

The centralizer assembly of any example, wherein each centralizer strip assembly is linear and substantially parallel with the centralizer axis.

The centralizer assembly of any example, further comprising an adapter assembly having a shaped support ring on which is mounted a connector, wherein the adapter abuts an end of the primary tubular and engages at least two centralizer strip assemblies.

The centralizer assembly of any example, wherein each connector is a pin that seats in a hollow centralizer strip assembly.

The centralizer assembly of any example, wherein the support ring is shaped to correspond with the cross section of the primary tubular cross section.

The centralizer assembly of any example, further comprising a second elongated, primary tubular member that is circular in cross-section and extending along a centralizer axis, the primary tubular member having a first end and a second end and a tubular wall extending between the first and second ends, the tubular wall having an inner surface and an outer surface; at least three centralizer strip assemblies symmetrically spaced about a perimeter of the second primary tubular, wherein each elongated centralizer strip assembly extends along at least a portion of the length of the primary tubular member, wherein each strip assembly has an arcuate shaped outer portion integrally formed in the tubular wall adjacent the outer surface of the tubular wall and an arcuate shaped inner portion integrally formed in the tubular wall adjacent the inner surface of the tubular wall so that the inner portion and outer portion of each centralizer strip assembly oppose one another on opposite sides of the tubular wall so that the opposing inner portion and outer portion of each centralizer strip assembly together form a secondary elongated tubular of hollow cross-section; and an adapter assembly having a shaped support ring on which is mounted a connector, wherein the adapter abuts the first end of the first primary tubular and the second end of the second primary tubular, and engages at least two centralizer strip assemblies of each of the first and second primary tubulars.

The centralizer assembly of any example, wherein each of the outer portion and an inner portion of each elongated centralizer strip assembly is integrally formed with adjacent tubular walls so that outer portion is coextensive with the outer surface of two adjoining walls and the inner portion is coextensive with the inner surface of the two adjoining walls.

The centralizer assembly of any example, further comprising a second elongated, primary tubular member that is polygonal in cross-section with at least three tubular walls forming the second primary tubular member and extending along a centralizer axis, where adjacent tubular walls of the second primary tubular join together at an intersection, the second primary tubular member having a first end and a second end with the tubular walls extending between the first and second ends, each tubular wall having an inner surface and an outer surface; a centralizer strip assembly formed by adjacent walls at each intersection of the second primary tubular member, wherein each elongated centralizer strip assembly of the second primary tubular member extends along at least a portion of the length of the second primary tubular member, wherein each strip assembly has an outer portion integrally formed in the tubular walls adjacent the outer surface of the tubular walls and an inner portion integrally formed in the tubular walls adjacent the inner surface of the tubular walls so that the inner portion and outer portion of each centralizer strip assembly are spaced apart from one another, wherein the outer portion of the strip assembly comprises a flexible outer spring, and wherein the inner portion of the strip assembly comprises an inner spring formed of a first inwardly depending leaf and a second inwardly depending leaf; and an adapter assembly having a support ring on which is mounted a connector, wherein the adapter abuts the first end of the first primary tubular and the second end of the second primary tubular, and engages at least two centralizer strip assemblies of each of the first and second primary tubulars.

The centralizer assembly of any example, further comprising an elastic sleeve disposed over a portion of each connecting rod assembly.

The centralizer assembly of any example, wherein the elastic sleeve is a rubber sleeve.

The centralizer assembly of any example, wherein the elongated connecting rod assemblies are hollow.

The centralizer assembly of any example, wherein the elongated connecting rod assemblies are metal.

The centralizer assembly of any example, wherein each strip assembly is engaged by a connecting rod assembly.

The centralizer assembly of any example, wherein the three or more centralizer strip assemblies comprises four strip assemblies; and wherein the three or more elongated connecting rod assemblies comprises four connecting rod assemblies.

The centralizer assembly of any example, wherein each seat is hollow.

The centralizer assembly of any example, wherein each seat is internally threaded and each rod end is externally threaded.

The centralizer assembly of any example, wherein each connecting rod assembly is circular in cross-section.

The centralizer assembly of any example, wherein the first end of each first connecting rod assembly is engaged with a seat at the first end of a first centralizer strip assembly, the centralizer assembly further comprising three or more elongated second connecting rod assemblies, each second connecting rod assembly having a first end and a second end and extending an axis parallel with the centralizer axis, wherein the second end of each second connecting rod assembly is engaged with a seat at the second end of a first centralizer strip assembly.

The centralizer assembly of any example, further comprising a second primary tubular member formed about a centralizer axis, the second primary tubular member having a first end and a second end and a tubular wall extending between the first and second ends, the tubular wall having an inner surface and an outer surface; and three or more second centralizer strip assemblies extending along at least a portion of the second primary tubular member and spaced apart from one another about a circumference of the second primary tubular member, wherein each second strip assembly has a first end and a second end, and an outer portion of adjacent the outer surface of the tubular wall and an inner portion adjacent the inner surface of the tubular wall so that the inner portion and outer portion of each second centralizer strip assembly oppose one another forming a seat at each of the first end and second end of the second strip assembly; wherein the first end of each second connecting rod assembly is engaged with a seat of a second centralizer strip assembly.

The centralizer assembly of any example, further comprising an elastic sleeve disposed over a portion of each connecting rod assembly.

The centralizer assembly of any example, wherein the elastic sleeve is a rubber overcoat.

The centralizer assembly of any example, wherein each seat of each centralizer strip assembly is hollow and each end of each rod includes a smaller diameter portion.

The centralizer assembly of any example, further comprising a tubular having a tubular wall with a tubular inner diameter, wherein the first and second primary tubular members are positioned in the tubular and the first connecting rod assemblies engage the tubular wall at the tubular inner diameter.

The centralizer assembly of any example, further comprising a sonde having a sonde tubular wall with a sonde outer diameter, wherein the first connecting rod assemblies engage the sonde tubular wall at the sonde outer diameter.

The centralizer assembly of any example, wherein each connecting rod assembly further comprises a secondary tubular with an elastomeric sheath disposed about the secondary tubular, wherein an outer portion of the elastomeric sheath engages the wall of the tubular and an inner portion of the elastomeric sheath engages the wall of the sonde.

The centralizer assembly of any example, wherein the outer radial lengths of at least two elongated centralizer strip assemblies are different from one another.

The centralizer assembly of any example, wherein each of the outer portion and an inner portion of an elongated centralizer strip assembly is integrally formed with tubular wall.

The centralizer assembly of any example, wherein the outer radial lengths of at least two elongated centralizer strip assemblies are the same.

The centralizer assembly of any example, wherein each of the two centralizer strip assemblies with the same outer radial length are spaced about the perimeter of the primary tubular the same angular distance from the centralizer strip assembly with the greatest outer radial length.

The centralizer assembly of any example, wherein the inner radial length of all of the centralizer strip assemblies is the same.

The centralizer assembly of any example, wherein one elongated centralizer strip assembly of the three or more elongated centralizer strip assemblies is spaced about the perimeter of the primary tubular a first angular distance from the centralizer strip assembly with the greatest outer radial length, and wherein another of the three or more elongated centralizer strip assemblies is spaced about the perimeter of the primary tubular a second angular distance from the centralizer strip assembly with the greatest outer radial length, where the first angular distance is greater than the second angular distance, and wherein elongated centralizer strip assembly spaced the first angular distance has an outer radial length that is less than the elongated centralizer strip assembly spaced the second angular distance.

The centralizer assembly of any example, wherein two centralizer strip assemblies are symmetrically spaced about the perimeter of the primary tubular the same angular distance from the centralizer strip assembly with the greatest outer radial length and the two symmetrically spaced centralizer strip assemblies have the same outer radial length.

The centralizer assembly of any example, wherein the elongated centralizer strip assembly with the longest outer radial length is a reference centralizer strip assembly, and wherein two strip assemblies are spaced apart from the reference strip assembly, as well as each other, around the perimeter of primary tubular member.

The centralizer assembly of any example, wherein the two strip assemblies are each spaced the same angular distance from the primary strip assembly and the have the same outer radial length and the same inner radial length.

The centralizer assembly of any example, wherein the elongated centralizer strip assembly with the longest outer radial length has the same inner radial length as the other centralizer strip assemblies.

The centralizer assembly of any example, further comprising an elastomeric overmold covering the elongated primary tubular member and each of the three or more elongated centralizer strip assemblies.

The centralizer assembly of any example, wherein the outer radial lengths of the second and third elongated centralizer strip assemblies are the same.

The centralizer assembly of any example, wherein the second and third centralizer strip assemblies are spaced about the perimeter of the primary tubular the same angular distance from the first centralizer strip assembly.

The centralizer assembly of any example, wherein the outer radial length of the second elongated strip assembly is greater than the outer radial length of the and third elongated centralizer strip assembly.

The centralizer assembly of any example, wherein the second elongated strip assembly is spaced about the perimeter of the primary tubular an angular distance from the first elongated strip assembly that is less than an angular distance the third elongated strip assembly is spaced from the first elongated strip assembly.

The centralizer assembly of any example, wherein each of the outer portion and an inner portion of an elongated centralizer strip assembly is integrally formed with tubular wall.

The centralizer assembly of any example, wherein the second elongated centralizer strip assembly spaced apart from the first elongated centralizer strip assembly a first angular distance and the third elongated centralizer strip assembly is spaced apart from the first elongated centralizer strip assembly a second angular distance that is the same as the first angular distance, and wherein the second outer radial length is the same as the third outer radial length.

The centralizer assembly of any example, wherein the second elongated centralizer strip assembly spaced apart from the first elongated centralizer strip assembly a first angular distance and the third elongated centralizer strip assembly is spaced apart from the first elongated centralizer strip assembly a second angular distance that is greater than the first angular distance, and wherein the second outer radial length is greater than as the third outer radial length.

The centralizer assembly of any example, wherein the two adjacent inwardly extending ridges of a side are joined by an outward transition ridge that is spaced apart from the outer diameter.

The centralizer assembly of any example, wherein the outwardly extending ridges of adjacent sides are adjacent one another.

The centralizer assembly of any example, wherein the adjacent sides of the tubular member are joined together by an inward transition ridge that is spaced apart from the inner diameter.

The centralizer assembly of any example, wherein the two adjacent inwardly extending ridges of a side are joined by an outward transition ridge that is spaced apart from the outer diameter; and wherein the adjacent sides of the tubular member are joined together by an inward transition ridge that is spaced apart from the inner diameter.

The centralizer assembly of any example, wherein the tubular wall has three sides.

The centralizer assembly of any example, wherein the tubular wall has four sides.

The centralizer assembly of any example, wherein each ridge has an apex and one or more ridges are rounded at its apex.

The centralizer assembly of any example, wherein each inwardly extending ridge and each outwardly extending ridge may have a height, wherein the height of each inwardly extending ridge is less than the height of each outwardly extending ridge.

The centralizer assembly of any example, wherein each outwardly extending ridge engage the inner diameter of a tubular and each inwardly extending ridge engages the outer diameter of a sonde.

The centralizer assembly of any example, wherein the tubular wall has at least four sides.

The centralizer assembly of any example, wherein the tubular wall has four outward transition ridges and four inward transition ridges.

The centralizer assembly of any example, wherein the two adjacent inwardly extending ridges of a side are joined by an outward transition ridge that is spaced apart from the outer diameter.

The centralizer assembly of any example, wherein the outwardly extending ridges of adjacent sides are adjacent one another.

The centralizer assembly of any example, wherein the adjacent sides of the tubular member are joined together by an inward transition ridge that is spaced apart from the inner diameter.

The centralizer assembly of any example, wherein the two adjacent inwardly extending ridges of a side are joined by an outward transition ridge that is spaced apart from the outer diameter; and wherein the adjacent sides of the tubular member are joined together by an inward transition ridge that is spaced apart from the inner diameter.

The centralizer assembly of any example, further comprising a tubular having a tubular wall with a tubular inner diameter, wherein the outwardly extending ridges each engage the tubular wall at the tubular inner diameter.

The centralizer assembly of any example, further comprising a sonde having a sonde tubular wall with a sonde outer diameter, wherein the inwardly extending ridges each engage the sonde tubular wall at the sonde outer diameter.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

What is claimed is:

1. A centralizer assembly for use in a wellbore, the centralizer comprising:

an elongated, primary tubular member extending along a centralizer axis, the primary tubular member having a first end and a second end and a tubular wall extending between the first and second ends, the tubular wall having an inner surface and an outer surface; and three or more elongated centralizer strip assemblies extending along at least a portion of the primary tubular member, wherein an outer portion of each centralizer strip assembly is adjacent the outer surface of the tubular wall and an inner portion of each centralizer strip assembly is adjacent the inner surface of the tubular wall so that the inner portion and outer portion of each centralizer strip assembly oppose one another on opposite sides of the tubular wall, wherein the outer portion of each elongated strip assembly has an outer radial length and the inner portion of each elongated strip assembly has an inner radial length, wherein the outer radial length of a first elongated centralizer strip assembly of the three or more elongated centralizer strip assemblies is longer than the outer radial lengths of second and third elongated centralizer strip assemblies of the three or more elongated centralizer strip assemblies, and wherein the outer radial length of the second elongated strip assembly is greater than the outer radial length of the third elongated centralizer strip assembly.

2. The centralizer strip assembly of claim 1, wherein the outer radial lengths of at least two elongated centralizer strip assemblies are different from one another.

3. The centralizer strip assembly of claim 1, wherein each of the outer portion and an inner portion of an elongated centralizer strip assembly is integrally formed with tubular wall.

4. The centralizer strip assembly of claim 1, wherein the outer radial lengths of at least two elongated centralizer strip assemblies are the same.

5. The centralizer strip assembly of claim 4, wherein each of the two centralizer strip assemblies with the same outer radial length are spaced about a perimeter of the primary tubular the same angular distance from the centralizer strip assembly with the greatest outer radial length.

6. The centralizer strip assembly of claim 1, wherein the inner radial length of all of the centralizer strip assemblies is the same.

7. The centralizer strip assembly of claim 1, wherein one elongated centralizer strip assembly of the three or more elongated centralizer strip assemblies is spaced about a perimeter of the primary tubular a first angular distance from the centralizer strip assembly with the greatest outer radial length, and wherein another of the three or more elongated centralizer strip assemblies is spaced about the perimeter of the primary tubular a second angular distance from the centralizer strip assembly with the greatest outer radial length, where the first angular distance is greater than the second angular distance, and wherein elongated centralizer strip assembly spaced the first angular distance has an outer radial length that is less than the elongated centralizer strip assembly spaced the second angular distance.

8. The centralizer strip assembly of claim 1, wherein two centralizer strip assemblies are symmetrically spaced about a perimeter of the primary tubular the same angular distance from the centralizer strip assembly with the greatest outer radial length and the two symmetrically spaced centralizer strip assemblies have the same outer radial length.

9. The centralizer strip assembly of claim 1, wherein the elongated centralizer strip assembly with the longest outer radial length is a reference centralizer strip assembly, and wherein two strip assemblies are spaced apart from the reference strip assembly, as well as each other, around a perimeter of primary tubular member.

10. The centralizer strip assembly of claim 9, wherein the two strip assemblies are each spaced the same angular distance from the primary strip assembly and the have the same outer radial length and the same inner radial length.

11. The centralizer strip assembly of claim 10, wherein the elongated centralizer strip assembly with the longest outer radial length has the same inner radial length as the other centralizer strip assemblies.

12. The centralizer strip assembly of claim 1, further comprising an elastomeric overmold covering the elongated primary tubular member and each of the three or more elongated centralizer strip assemblies.

13. A centralizer assembly for use in a wellbore, the centralizer comprising:

an elongated, primary tubular member extending along a centralizer axis, the primary tubular member having a first end and a second end and a tubular wall extending between the first and second ends, the tubular wall having an inner surface and an outer surface; and a first, second and third elongated centralizer strip assembly extending along at least a portion of the primary tubular member, wherein an outer portion of each centralizer strip assembly is adjacent the outer surface of the tubular wall and an inner portion of each centralizer strip assembly is adjacent the inner surface of the tubular wall so that the inner portion and outer portion of each centralizer strip assembly oppose one another on opposite sides of the tubular wall, wherein the outer portion of each elongated strip assembly has an outer radial length and the inner portion of each elongated strip assembly has an inner radial length, wherein the outer radial length of the first elongated centralizer strip assembly is longer than the outer radial lengths of the second and third elongated centralizer strip assemblies, and wherein the inner radial length of all of the centralizer strip assemblies is the same, and wherein the outer radial length of the second elongated strip assembly is greater than the outer radial length of the third elongated centralizer strip assembly.

14. The centralizer strip assembly of claim 13, wherein the outer radial lengths of the second and third elongated centralizer strip assemblies are the same.

15. The centralizer strip assembly of claim 14, wherein the second and third centralizer strip assemblies are spaced about a perimeter of the primary tubular the same angular distance from the first centralizer strip assembly.

16. The centralizer strip assembly of claim 13, wherein the second elongated strip assembly is spaced about a perimeter of the primary tubular an angular distance from the first elongated strip assembly that is less than an angular distance the third elongated strip assembly is spaced from the first elongated strip assembly.

17. The centralizer strip assembly of claim 13, wherein each of the outer portion and an inner portion of an elongated centralizer strip assembly is integrally formed with tubular wall.

18. A centralizer assembly for use in a wellbore, the centralizer comprising:

an elongated, primary tubular member extending along a centralizer axis, the primary tubular member having a first end and a second end and a tubular wall extending between the first and second ends, the tubular wall having an inner surface and an outer surface;

a first elongated centralizer strip assembly extending linearly along at least a portion of the primary tubular member so as to be parallel to the centralizer axis, the first elongated centralizer strip assembly having an outer portion adjacent the outer surface of the tubular wall and an inner portion adjacent the inner surface of the tubular wall where the inner portion and outer portion oppose one another on opposite sides of the tubular wall, the outer portion of the first elongated centralizer strip assembly having a first outer radial length and the inner portion of the first elongated centralizer strip assembly having a first inner radial length;

a second elongated centralizer strip assembly spaced apart from the first elongated centralizer strip assembly about a perimeter of the elongated, primary tubular member, the second elongated centralizer strip assembly extending linearly along at least a portion of the primary tubular member so as to be parallel to the centralizer axis, the second elongated centralizer strip assembly having an outer portion adjacent the outer surface of the tubular wall and an inner portion adjacent the inner surface of the tubular wall where the inner portion and outer portion oppose one another on opposite sides of the tubular wall, the outer portion of the second elongated centralizer strip assembly having a second outer radial length and the inner portion of the second elongated centralizer strip assembly having a second inner radial length; and a third elongated centralizer strip assembly spaced apart from the first elongated centralizer strip assembly and the second elongated strip assembly about the perimeter of the elongated, primary tubular member, the third elongated centralizer strip assembly extending linearly along at least a portion of the primary tubular member so as to be parallel to the centralizer axis, the third elongated centralizer strip assembly having an outer portion adjacent the outer surface of the tubular wall and an inner portion adjacent the inner surface of the tubular wall where the inner portion and outer portion oppose one another on opposite sides of the tubular wall, the outer portion of the third elongated centralizer strip assembly having a third outer radial length and the inner portion of the third elongated centralizer strip assembly having a third inner radial length;

wherein the first outer radial length is greater than the second outer radial length and the third outer radial length, wherein the second outer radial length is greater than the third outer radial length; and wherein the first, second and third inner radial lengths are the same.

19. The centralizer strip assembly of claim 18, wherein the second elongated centralizer strip assembly spaced apart from the first elongated centralizer strip assembly a first angular distance and the third elongated centralizer strip assembly is spaced apart from the first elongated centralizer strip assembly a second angular distance that is the same as the first angular distance.

20. The centralizer strip assembly of claim 18, wherein the second elongated centralizer strip assembly spaced apart from the first elongated centralizer strip assembly a first angular distance and the third elongated centralizer strip assembly is spaced apart from the first elongated centralizer strip assembly a second angular distance that is greater than the first angular distance.

* * * * *